US011772388B2

(12) United States Patent
Yoshikawa et al.

(10) Patent No.: US 11,772,388 B2
(45) Date of Patent: Oct. 3, 2023

(54) THERMAL PRINT HEAD

(71) Applicant: ROHM CO., LTD., Kyoto (JP)

(72) Inventors: Yasuhiro Yoshikawa, Kyoto (JP); Toshihiro Kimura, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 136 days.

(21) Appl. No.: 17/595,414

(22) PCT Filed: May 25, 2020

(86) PCT No.: PCT/JP2020/020574
§ 371 (c)(1),
(2) Date: Nov. 16, 2021

(87) PCT Pub. No.: WO2020/241581
PCT Pub. Date: Dec. 3, 2020

(65) Prior Publication Data

US 2022/0203702 A1 Jun. 30, 2022

(30) Foreign Application Priority Data

May 27, 2019 (JP) ..... 2019-098385

(51) Int. Cl.
*B41J 2/335* (2006.01)
*B41J 2/345* (2006.01)

(52) U.S. Cl.
CPC ..... *B41J 2/345* (2013.01); *B41J 2/335* (2013.01); *B41J 2/3355* (2013.01); *B41J 2/33535* (2013.01)

(58) Field of Classification Search
CPC ..... B41J 2/345; B41J 2/335; B41J 2/33535; B41J 2/3355
See application file for complete search history.

(56) References Cited

U.S. PATENT DOCUMENTS 5,570,123 A 10/1996 Almonte
2012/0154504 A1* 6/2012 Ono ..... B41J 2/33515 29/874

(Continued)

FOREIGN PATENT DOCUMENTS

JP 5-116361 A 5/1993
JP 2009-248521 A 10/2009

(Continued)

OTHER PUBLICATIONS

International Search Report issued in PCT/JP2020/020574, dated Jul. 7, 2020 (2 pages).

(Continued)

*Primary Examiner* — Yaovi M Ameh
(74) *Attorney, Agent, or Firm* — Hamre, Schumann, Mueller & Larson, P.C.

(57) ABSTRACT

A thermal print head includes a heat-generating substrate, a resistor layer, a conductive layer, a first substrate, a second substrate, and a third substrate. The heat-generating substrate includes a heat-generating substrate obverse face and a heat-generating substrate reverse face that are spaced apart from each other in a thickness direction. The resistor layer is supported by the heat-generating substrate. The conductive layer is supported by the heat-generating substrate, and electrically connected to the resistor layer. The first substrate is located upstream of the heat-generating substrate in a sub-scanning direction. The second substrate is located upstream of the first substrate in the sub-scanning direction. The third substrate is bonded to the first substrate and the second substrate and higher in flexibility than the first substrate.

16 Claims, 24 Drawing Sheets

(56) References Cited

U.S. PATENT DOCUMENTS

| | | | | |
|---|---|---|---|---|
| 2014/0333708 | A1* | 11/2014 | Ochi | B41J 2/3357<br>347/203 |
| 2016/0001573 | A1* | 1/2016 | Yoneta | B41J 2/3358<br>347/208 |
| 2018/0354265 | A1* | 12/2018 | Aoki | B41J 2/33535 |

FOREIGN PATENT DOCUMENTS

| | | | |
|---|---|---|---|
| JP | 2016-212952 | A | 12/2016 |
| JP | 2017-65021 | A | 4/2017 |
| JP | 2019-14233 | A | 1/2019 |

OTHER PUBLICATIONS

Search Report received in the corresponding European Patent application, dated Jan. 13, 2023 (6 pages).
Office Action received in the corresponding Chinese Patent application, dated Sep. 5, 2022, and machine translation (11 pages).

* cited by examiner

A1

A6

A8

A9

THERMAL PRINT HEAD

TECHNICAL FIELD

The present disclosure relates to a thermal print head.

BACKGROUND ART

Patent document 1 discloses an example of a conventional thermal print head. The thermal print head disclosed in the document (see FIG. 1) includes a heat-generating substrate on which heating elements are formed, a circuit board on which a driver IC and a connector are mounted, and a heat-dissipating member supporting the heat-generating substrate and the circuit board. The circuit board is, for example, made of a glass epoxy substrate, which lacks flexibility. Accordingly, only limited methods are available to mount the circuit board on the heat-dissipating member, and therefore the degree of freedom in designing is insufficient.

PRIOR ART DOCUMENT

Patent Document

Patent Document 1: JP-A-2017-65021

SUMMARY OF INVENTION

Problem to be Solved by the Invention

In view of the foregoing situation, the present disclosure provides a thermal print head that improves the degree of freedom in designing.

Means to Solve the Problem

In an aspect, the present disclosure provides a thermal print head including a heat-generating substrate having a heat-generating substrate obverse face and a heat-generating substrate reverse face spaced apart from each other in a thickness direction, a resistor layer supported by the heat-generating substrate, a conductive layer supported by the heat-generating substrate, and electrically connected to the resistor layer, a first substrate located upstream of the heat-generating substrate in a sub-scanning direction, a second substrate located upstream of the first substrate in the sub-scanning direction, and a third substrate bonded to the first substrate and the second substrate, and higher in flexibility than the first substrate.

Advantages of the Invention

According to the present disclosure, the two circuit boards (first substrate and second substrate) are connected to each other via the third substrate, which is flexible. Such a configuration provides higher degree of freedom in selecting the method for mounting the circuit boards on the heat-dissipating member, thereby allowing the thermal print head to be designed in a wider variety.

Other features and advantages of the present disclosure will become more apparent, through detailed description given hereunder with reference to the accompanying drawings.

MODE FOR CARRYING OUT THE INVENTION

Figure 1:
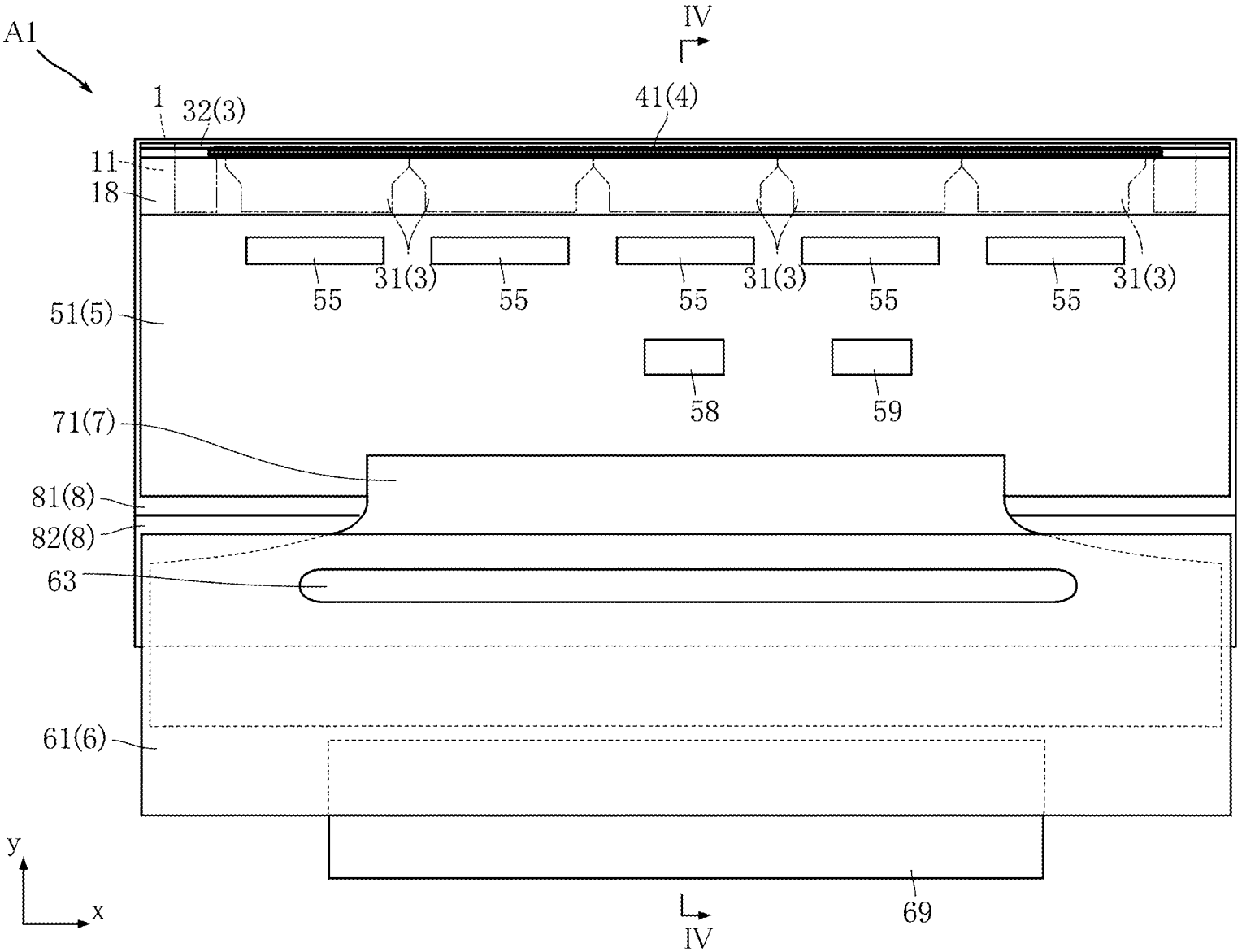
FIG. 1 is a plan view showing a thermal print head according to a first embodiment.

Hereafter, exemplary embodiments of the present disclosure will be described in detail, with reference to the drawings.

FIG. 1 to FIG. 6 illustrate a thermal print head according to a first embodiment. The illustrated thermal print head A1 includes a heat-generating substrate 1, a protective layer 2, a conductive layer 3, a resistor layer 4, an insulation layer 18, a first substrate 5, a driver IC 55, a thermistor 58, a capacitor 59, a second substrate 6, a connector 69, a third substrate 7, and a heat-dissipating member 8. The thermal print head A1 is to be incorporated in a printer that performs printing on a printing medium (not shown) interposed between the thermal print head A1 and a platen roller 91. Examples of the printing medium include a thermal paper for making a barcode sheet or a date code sheet.

Figure 2:
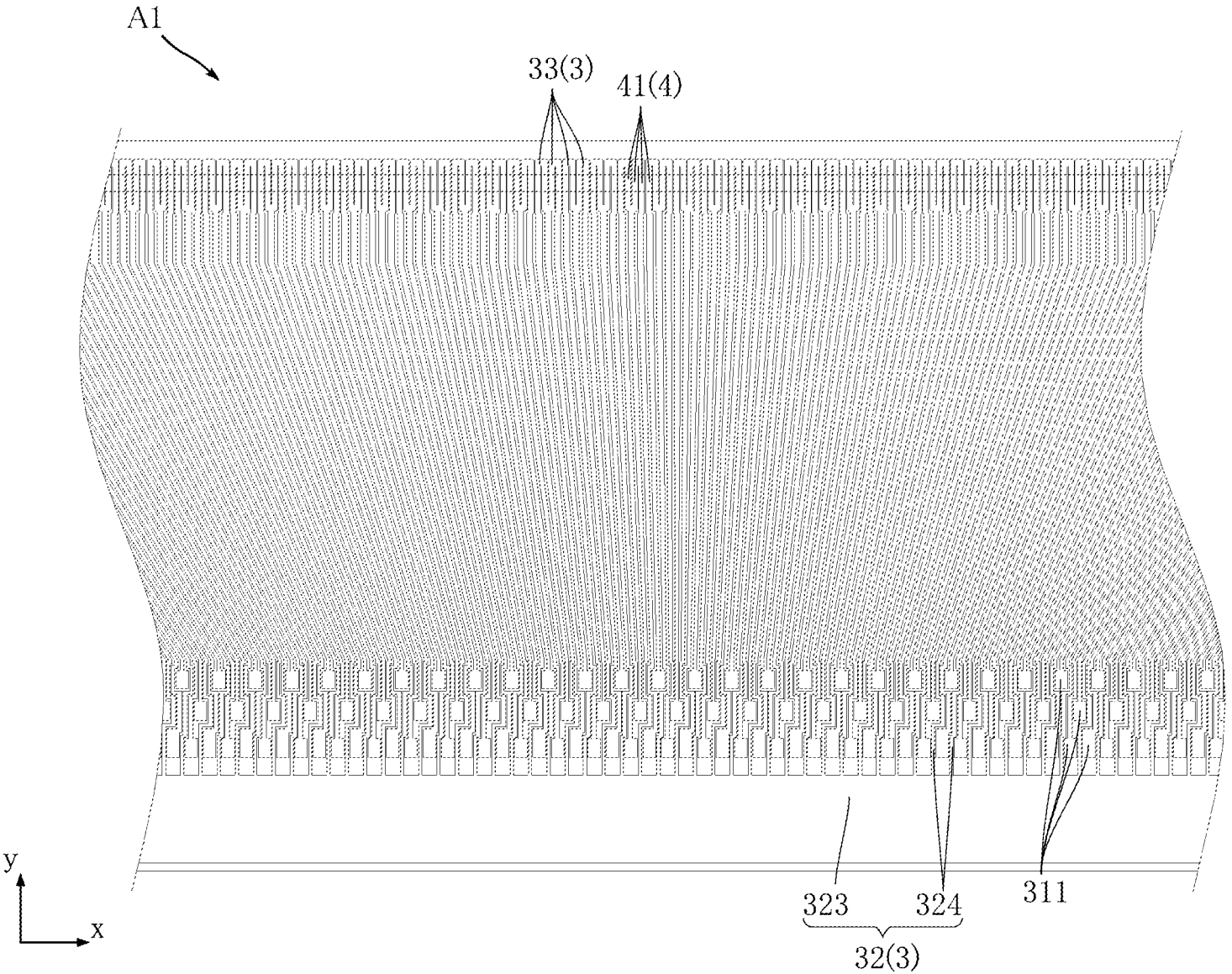
FIG. 2 is a partial plan view of the thermal print head shown in FIG. 1.
Figure 3:
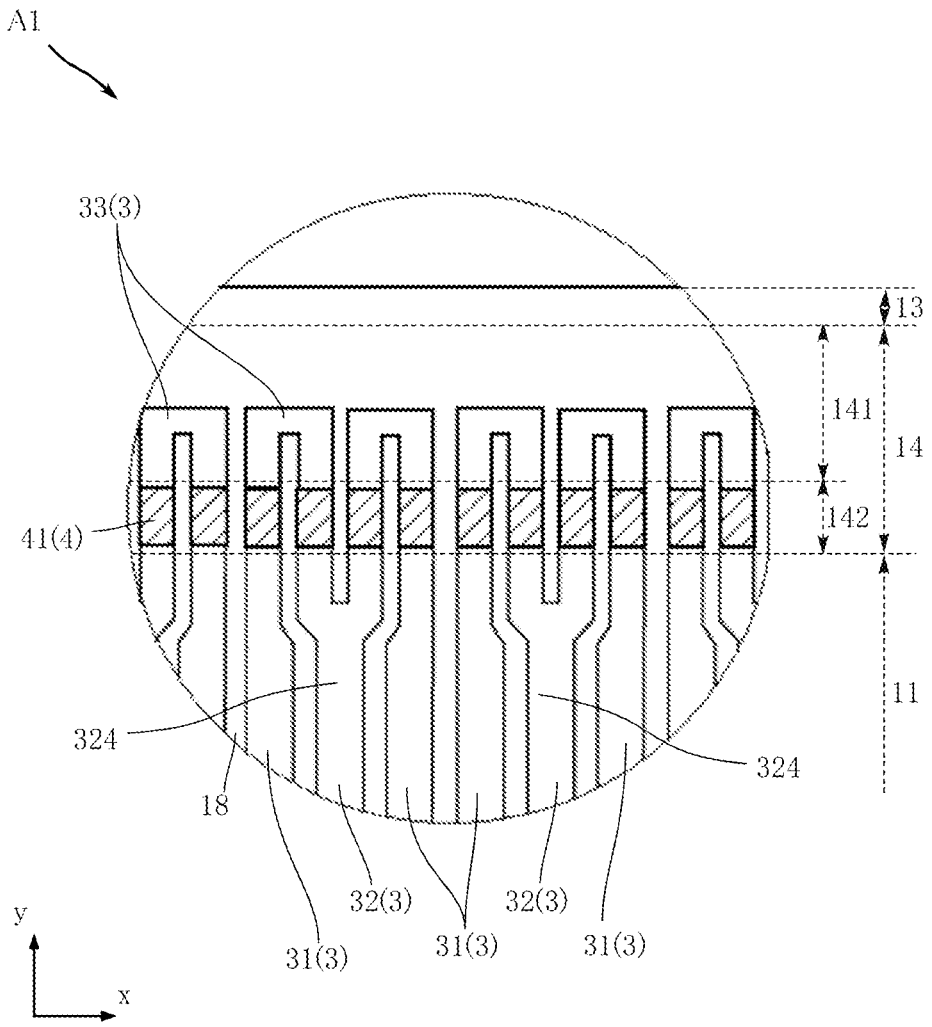
FIG. 3 is a partially enlarged plan view of the thermal print head shown in FIG. 1.
Figure 4:
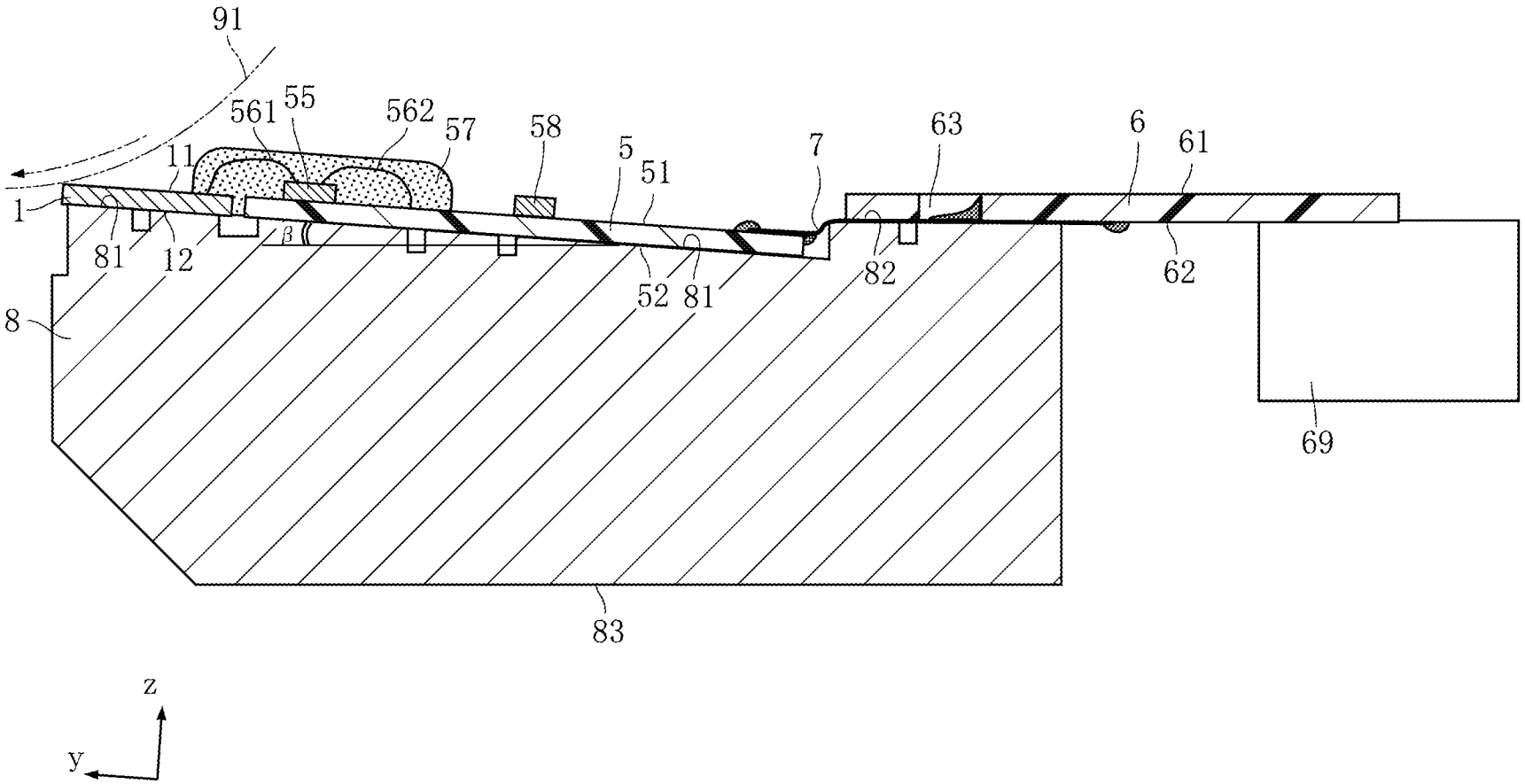
FIG. 4 is a cross-sectional view taken along a line IV-IV in FIG. 1.
Figure 5:
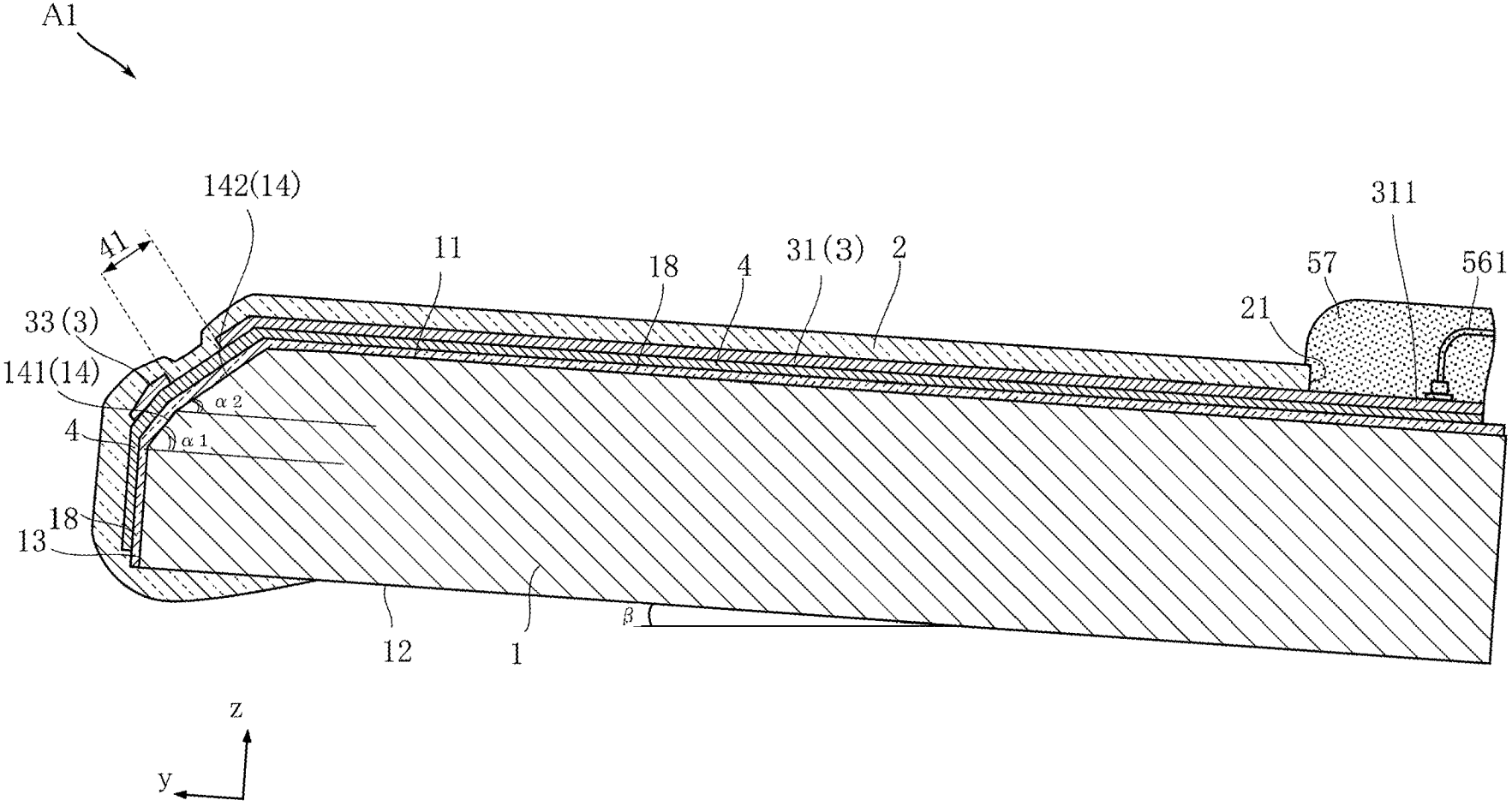
FIG. 5 is a partial cross-sectional view of the thermal print head shown in FIG. 1.
Figure 6:
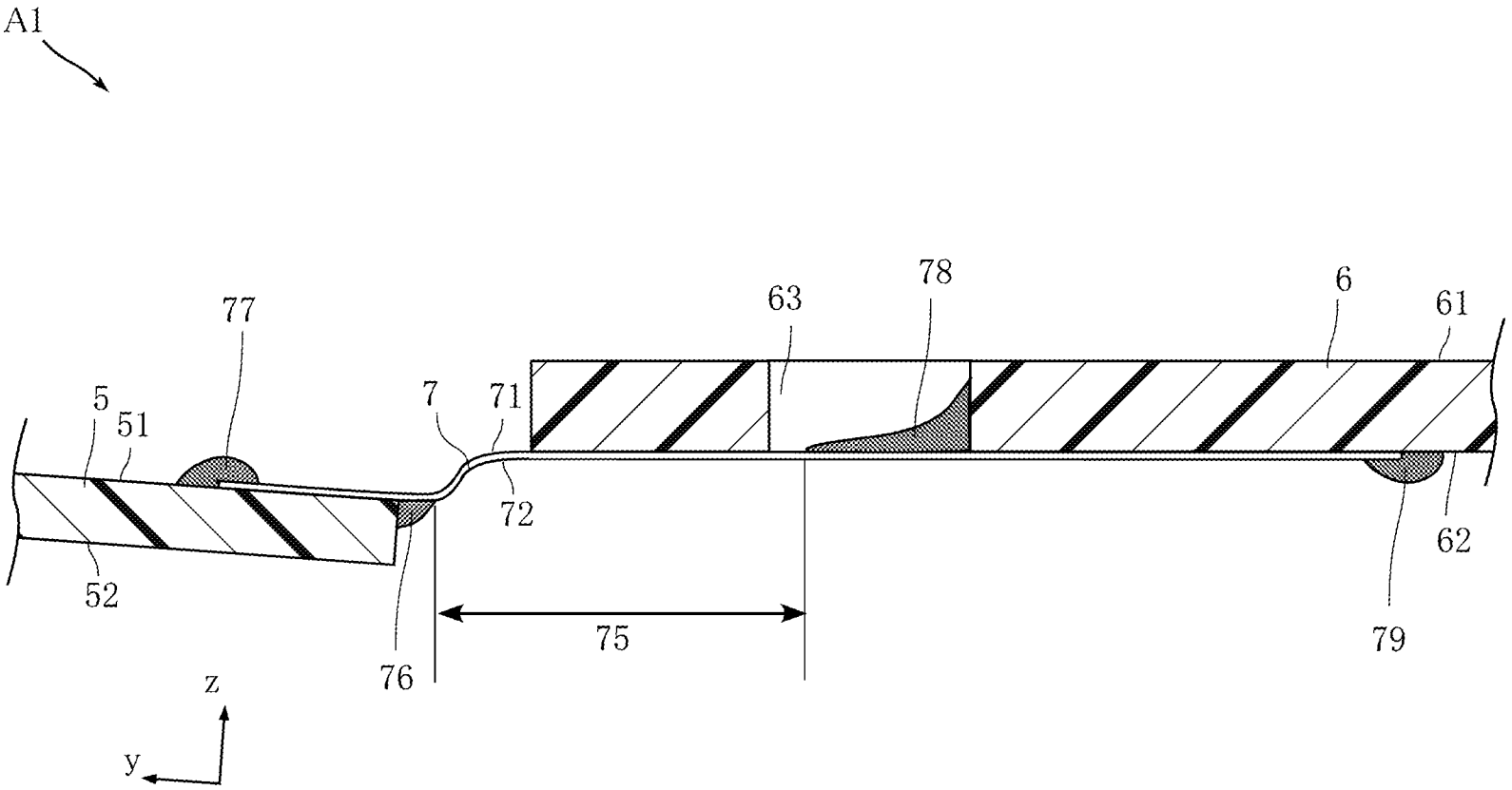
FIG. 6 is a partially enlarged cross-sectional view of the thermal print head shown in FIG. 1.

FIG. 1 is a plan view showing the thermal print head A1. FIG. 2 is a partial plan view of the thermal print head A1. FIG. 3 is a partially enlarged plan view of the thermal print head A1. FIG. 4 is a cross-sectional view taken along a line IV-IV in FIG. 1. FIG. 5 is a partial cross-sectional view of the thermal print head A1. FIG. 6 is a partially enlarged cross-sectional view of the thermal print head A1. In FIG. 1 to FIG. 3, the protective layer 2 is not shown. In FIG. 1 and FIG. 2, a protective resin 57, to be subsequently described, is not shown. In FIG. 2, a wire 561, to be subsequently described, is not shown. In these drawings, the longitudinal direction (main scanning direction) of the heat-generating substrate 1 will be defined as x-direction, and the transverse direction (sub-scanning direction) will be defined as y-direction. Further, a direction orthogonal to both of the x-direction and the y-direction will be defined as z-direction (thickness direction). In FIG. 4, the platen roller 91 rotates clockwise, as indicated by an arrow. Accordingly, the printing medium is transported from the right to the left in FIG. 4, along the y-direction. In the present disclosure, the side to which the printing medium is transported in the y-direction (sub-scanning direction) will be defined as "downstream side", and the opposite side of the downstream side will be defined as "upstream side", on the basis of the transport direction of the printing medium. According to such definition, the first substrate 5 is located upstream (y-direction) of the heat-generating substrate 1, and downstream (y-direction) of the second substrate 6, for example in FIG. 4.

The heat-generating substrate 1 serves to support the conductive layer 3 and the resistor layer 4. The heat-generating substrate 1 has a rectangular shape, having the long sides extending in the x-direction, and the short sides extending in the y-direction. The size of the heat-generating substrate 1 is not specifically limited. For example, the heat-generating substrate 1 may have a thickness of approximately 0.5 to 1 mm. The size of the heat-generating substrate 1 in the x-direction may be, for example, approximately 50 to 150 mm, and the size in the y-direction may be, for example, approximately 1 to 5 mm.

The heat-generating substrate 1 is made of a monocrystalline semiconductor, such as Si. As shown in FIG. 4 and FIG. 5, the heat-generating substrate 1 includes a heat-generating substrate obverse face 11 and a heat-generating substrate reverse face 12. The heat-generating substrate obverse face 11 and the heat-generating substrate reverse face 12 are oriented to opposite sides to each other in the z-direction, and parallel to each other. The heat-generating substrate obverse face 11 corresponds to the face oriented upward in FIG. 4 and FIG. 5. The heat-generating substrate reverse face 12 corresponds to the face oriented downward in FIG. 4 and FIG. 5.

As shown in FIG. 5, the heat-generating substrate 1 includes a heat-generating substrate end face 13 and a heat-generating substrate slanting face 14. The heat-generating substrate end face 13 is orthogonal to the y-direction, and oriented to the downstream side in the y-direction. The heat-generating substrate end face 13 is connected to the heat-generating substrate reverse face 12. The heat-generating substrate slanting face 14 is connected to the heat-generating substrate obverse face 11 and the heat-generating substrate end face 13. The heat-generating substrate slanting face 14 is inclined with respect to the heat-generating substrate obverse face 11 and the heat-generating substrate end face 13. The heat-generating substrate slanting face 14 includes a first slanting face 141 and a second slanting face 142. The first slanting face 141 is connected to the heat-generating substrate end face 13. The boundary between the first slanting face 141 and the heat-generating substrate end face 13 has a convex shape. The second slanting face 142 is connected to the heat-generating substrate obverse face 11. The boundary between the second slanting face 142 and the heat-generating substrate obverse face 11 has a convex shape. The second slanting face 142 is inclined with respect to the first slanting face 141, and the boundary between the first slanting face 141 and the second slanting face 142 has a convex shape.

The first slanting face 141 is inclined with respect to the heat-generating substrate obverse face 11, by an angle $\alpha 1$. The second slanting face 142 is inclined with respect to the heat-generating substrate obverse face 11, by an angle $\alpha 2$. In this embodiment, the heat-generating substrate obverse face 11 is expressed as (100) by Miller index. Hereinafter, a surface that can be expressed as (abc) by Miller index will be simply referred to as "(abc) surface". Thus, the heat-generating substrate obverse face 11 is a (100) surface. According to an example of the manufacturing method to be subsequently described, the angle $\alpha 1$ defined by the first slanting face 141 and the heat-generating substrate obverse face 11 is 54.7°, and the angle $\alpha 2$ defined by the second slanting face 142 and the heat-generating substrate obverse face 11 is 30°. However, the angles $\alpha 1$ and $\alpha 2$ are not limited to the mentioned example. The first slanting face 141 and the second slanting face 142 are formed as a rectangular flat face elongate in the x-direction, when viewed in the z-direction.

As shown in FIG. 5, the insulation layer 18 covers the heat-generating substrate obverse face 11, the heat-generating substrate end face 13, and the heat-generating substrate slanting face 14, to assure that the heat-generating substrate 1 is insulated from the resistor layer 4 and the conductive layer 3. It suffices that the insulation layer 18 is formed on a region of the heat-generating substrate 1 where the resistor layer 4 or the conductive layer 3 is to be formed. The insulation layer 18 is made of an insulative material, such as $SiO_2$, SiN, or tetraethyl orthosilicate (TEOS). In this embodiment, the insulation layer 18 is made of TEOS. However, the material of the insulation layer 18 is not specifically limited. The thickness of the insulation layer 18 is not specifically limited but may be, for example, 5 μm to 15 μm, and more preferably 5 μm to 10 μm.

The resistor layer 4 is supported by the heat-generating substrate 1, via the insulation layer 18. The resistor layer 4 covers at least a part of the heat-generating substrate obverse face 11, at least a part of the heat-generating substrate end face 13, and at least a part of the heat-generating substrate slanting face 14. The resistor layer 4 includes a plurality of heating elements 41. The plurality of heating elements 41 are each selectively energized, so as to locally heat the printing medium. In this embodiment, the heating elements 41 correspond to the region of the resistor layer 4 exposed from the conductive layer 3, and located on the second slanting face 142. The plurality of heating elements 41 are aligned in the x-direction, and spaced apart from each other in the x-direction. The shape of the heating element 41 is not specifically limited. In this embodiment, the heating elements 41 each have a rectangular shape elongate in the y-direction, when viewed in the z-direction. The resistor layer 4 is made of TaN, for example. The thickness of the resistor layer 4 is not specifically limited but may be, for example, 0.02 μm to 0.1 μm, and more preferably approximately 0.08 μm.

The conductive layer 3 serves as a conduction path for supplying power to the plurality of heating elements 41. The conductive layer 3 is supported by the heat-generating substrate 1 and, in this embodiment, stacked on the resistor layer 4 as shown in FIG. 5. The conductive layer 3 is formed so as to expose the portion of the resistor layer 4 to serve as the heating element 41. The conductive layer 3 is made of a material lower in resistance than the resistor layer 4, for example Cu. The thickness of the conductive layer 3 is not specifically limited but may be, for example, 0.3 μm to 2.0 μm.

As shown in FIG. 1 to FIG. 3, and FIG. 5, the conductive layer 3 includes a plurality of individual electrodes 31, a common electrode 32, and a plurality of relay electrodes 33, in this embodiment.

As shown in FIG. 3, the plurality of individual electrodes 31 are each formed in a belt-like shape extending generally in the y-direction, and located on the heat-generating substrate obverse face 11 and the second slanting face 142. Therefore, the plurality of individual electrodes 31 are located upstream of the plurality of heating elements 41, in the y-direction. The plurality of individual electrodes 31 are respectively connected to different ones of the heating elements 41. As shown in FIG. 2 and FIG. 5, the individual electrode 31 includes an individual pad 311. To the individual pad 311, the wire 561 for electrical conduction to the driver IC 55 is connected.

As shown in FIG. 2, FIG. 3, and FIG. 5, the common electrode 32 is located on the heat-generating substrate obverse face 11 and the second slanting face 142, and includes a common region 323 and a plurality of belt-like portions 324. The plurality of belt-like portions 324 each extend in the y-direction. As shown FIG. 3, an end portion of each of the plurality of belt-like portions 324 (downstream side in y-direction) is branched into two sections, and the branched sections are respectively connected to two heating elements 41 located adjacent to each other. As shown in FIG. 2, the common region 323 extends in the x-direction along the other end portion of the plurality of belt-like portions 324 (upstream side in y-direction), and is continuous therewith.

As shown in FIG. 3, the plurality of relay electrodes 33 are located on the first slanting face 141 and the second slanting face 142, and each formed in a C-shape with the opening oriented to the upstream side in the y-direction. In the example illustrated in FIG. 3, the relay electrodes 33 each include a pair of belt-like portions extending in the y-direction parallel to each other, and a connecting belt-like portion extending in the x-direction, so as to connect between the respective end portions of the pair of belt-like portions. The plurality of relay electrodes 33 are aligned at regular intervals in the x-direction, along the downstream side of the heating element 41 in the y-direction. The relay electrodes 33 are each connected to two heating elements 41 located adjacent to each other.

As shown in FIG. 3, the belt-like portions 324 of the common electrode 32 are each interposed between two of the individual electrodes 31, and connected to two of the heating elements 41 located adjacent to each other. One of the two heating elements 41 is connected to one of the two individual electrodes 31, via the corresponding relay electrode 33, and the other of the two heating elements 41 is connected to the other of the two individual electrodes 31, via the corresponding relay electrode 33. With such a configuration, when one of the individual electrodes 31 is energized, two of the heating elements 41 (i.e., the heating element directly connected to the individual electrode 31, and the heating element indirectly connected thereto via the relay electrode 33) simultaneously generate heat.

The shape and the location of the conductive layer 3 are not specifically limited. For example, the relay electrode 33 may be excluded, the common electrode 32 may be located downstream of the heating elements 41 in the y-direction, and the heating elements 41 may be respectively connected to different ones of the belt-like portions 324 of the common electrode 32, and different ones of the individual electrodes 31.

The protective layer 2 is formed so as to overlap with each of the heat-generating substrate obverse face 11, the heat-generating substrate slanting face 14, the heat-generating substrate end face 13, and the heat-generating substrate reverse face 12 of the heat-generating substrate 1, and covers the conductive layer 3 and the resistor layer 4. The protective layer 2 is made of an insulative material, and serves to protect the conductive layer 3 and the resistor layer 4. The protective layer 2 may be composed of a single layer or a plurality of layers of, for example, $SiO_2$, SiN, SiC, or AlN. The thickness of the protective layer 2 is not specifically limited but may be, for example, approximately 1.0 μm to 10 μm.

In the example illustrated in FIG. 5, the protective layer 2 includes an opening for pad 21. The opening for pad 21 is formed so as to penetrate through the protective layer 2 in the z-direction. The plurality of openings for pad 21 expose the individual pad 311 of the respective individual electrodes 31.

The first substrate 5 is located upstream of the heat-generating substrate 1 in the y-direction, as shown in FIG. 1, FIG. 4, and FIG. 6. The first substrate 5 is for example a PCB substrate, and the driver IC 55, the thermistor 58, and the capacitor 59 are mounted thereon. The shape of the first substrate 5 is not specifically limited. In this embodiment, the first substrate 5 has a rectangular shape elongate in the x-direction. The first substrate 5 includes a first substrate obverse face 51 and a first substrate reverse face 52. The first substrate obverse face 51 is oriented to the same side as is the heat-generating substrate obverse face 11 of the heat-generating substrate 1, and the first substrate reverse face 52 is oriented to the same side as is the heat-generating substrate reverse face 12 of the heat-generating substrate 1. On the first substrate obverse face 51, a first wiring (not shown) is formed. To the first wiring, the driver IC 55 is bonded, and also a wire 562 is bonded. Accordingly, in this embodiment, an Au-plated layer of high purity is formed through an electrolytic plating process, for example on a wiring made of Cu, to form the first wiring.

The driver IC 55 is mounted on the first substrate obverse face 51 of the first substrate 5, to energize the respective heating elements 41. In this embodiment, the driver IC 55 is connected to the plurality of individual electrodes 31, via the plurality of wires 561. The driver IC 55 controls the power supply according to a command signal inputted from outside of the thermal print head A1, through the first substrate 5, the second substrate 6, and the third substrate 7. The driver IC 55 is connected to a first conductive layer of the first substrate 5, via a plurality of wires 562. In this embodiment, a plurality of driver ICs 55 are provided, depending on the number of the heating elements 41.

The driver IC 55, the plurality of wires 561, and the plurality of wires 562 are covered with the protective resin 57. The protective resin 57 is, for example, made of a black insulative resin. The protective resin 57 is formed so as to stride over the heat-generating substrate 1 and the first substrate 5.

The thermistor 58 is mounted on the first substrate obverse face 51 of the first substrate 5, and serves to detect temperature. The thermistor 58 outputs an electrical signal corresponding to the detected temperature, to the driver IC 55. The driver IC 55 executes a processing according to the temperature detected by the thermistor 58. For example, the driver IC 55 records the temperature detected by the thermistor 58, as a thermal history of the heat-generating substrate 1. In addition, when the temperature detected by the thermistor 58 reaches a predetermined temperature or higher, the driver IC 55 stops supplying power to the heating element 41 to prevent thermal runaway, and outputs a notice of error. In this embodiment, the thermistor 58 is located upstream of the driver IC 55 in the y-direction, at a position in the vicinity of the protective resin 57 covering the driver IC 55.

The capacitor 59 is a bypass capacitor that sends an AC component, such as a noise superposed on the DC power supplied to the driver IC 55, to the ground. The capacitor 59 is connected between a wiring to which the power source terminal of the driver IC 55 is connected, and the ground wiring.

The second substrate 6 is located upstream of the first substrate 5 in the y-direction, as shown in FIG. 1, FIG. 4, and FIG. 6. The second substrate 6 is for example a PCB substrate, on which other circuit elements that are not shown, and the connector 69 are mounted. The shape of the second substrate 6 is not specifically limited. In this embodiment, the second substrate 6 has a rectangular shape elongate in the x-direction. The second substrate 6 includes a second substrate obverse face 61 and a second substrate reverse face 62. The second substrate obverse face 61 is oriented to the same side as is the heat-generating substrate obverse face 11 of the heat-generating substrate 1, and the second substrate reverse face 62 is oriented to the same side as is the heat-generating substrate reverse face 1 of the heat-generating substrate 1. In this embodiment, the second substrate 6 is inclined with respect to the heat-generating substrate 1 and the first substrate 5. In this embodiment, the second substrate obverse face 61 is on the upper side in the z-direction, with respect to the first substrate obverse face 51. On the second substrate obverse face 61 and the second substrate reverse face 62, a second wiring (not shown) is formed. The second wiring is merely formed by anti-oxidation treatment, for example on a wiring of Cu, because although other circuit elements are surface-mounted, wire bonding is unnecessary, in this embodiment. The material and forming method of the second wiring are not specifically limited. The second substrate 6 includes a through-hole 63. The through-hole 63 is formed all the way from the second substrate obverse face 61 to the second substrate reverse face 62 as shown in FIG. 4 and FIG. 6, and extends in the x-direction as show in FIG. 1.

The connector 69 is used to connect the thermal print head A1 to a printer (not shown). The connector 69 is attached to the second substrate reverse face 62, and connected to the second conductive layer.

The third substrate 7 is bonded to the first substrate 5 and the second substrate 6, and more flexible than the first substrate 5 and the second substrate 6. The third substrate 7 is a flexible print substrate, and includes a third wiring connecting between the first conductive layer of the first substrate 5 and the second conductive layer of the second substrate 6. Since the first substrate 5 and the second substrate 6 are connected to each other via the third substrate 7 which is flexible, the second substrate 6 can be mounted in an inclined posture with respect to the first substrate 5. The shape of the third substrate 7 is not specifically limited. In this embodiment, as shown in FIG. 1, the size of the portion of the third substrate 7 bonded to the second substrate 6 in the x-direction is generally the same as the size of the second substrate 6 in the x-direction, and the size of the portion of the third substrate 7 bonded to the first substrate 5 in the x-direction is smaller than the size of the heat-generating substrate 1 in the x-direction.

As shown in FIG. 6, the third substrate 7 includes a third obverse face 71 and a third reverse face 72 oriented to opposite sides to each other. The portion of the third obverse face 71 on the upstream side in the y-direction is bonded to the second substrate reverse face 62. The portion of the third reverse face 72 on the downstream side in the y-direction is bonded to the first substrate obverse face 51. To prevent the third substrate 7 from separating from the first substrate 5 or the second substrate 6, bonding reinforcement members 76 to 79 are provided. The bonding reinforcement members 76 to 79 are formed by curing a resin, and serve to reinforce the adhesion. The material of the bonding reinforcement members 76 to 79 is not specifically limited. The bonding reinforcement member 76 is formed in contact with the end face of the first substrate 5 on the upstream side in the y-direction, and the third reverse face 72, and extends in the x-direction. The bonding reinforcement member 77 is formed so as to stride over the end portion of the third obverse face 71 on the downstream side in the y-direction, and the first substrate obverse face 51, and extends in the x-direction. The bonding reinforcement member 78 is formed in contact with the inner wall of the through-hole 63 and the third obverse face 71, and extends in the x-direction. The bonding reinforcement member 79 is formed so as to stride over the end portion of the third reverse face 72 on the upstream side in the y-direction and the second substrate reverse face 62, and extends in the x-direction. Accordingly, the portion of the third substrate 7 indicated as bending range 75 in FIG. 6, corresponds to a bendable portion of the third substrate 7.

The heat-dissipating member 8 supports the heat-generating substrate 1, the first substrate 5, and the second substrate 6, and serves to dissipate a part of the heat generated by the plurality of heating elements 41 to outside, through the heat-generating substrate 1. The heat-dissipating member 8 is a block-shaped member made of a metal such as aluminum and, for example, formed through an extrusion molding process. The shape and forming method of the heat-dissipating member 8 are not specifically limited. As shown in FIG. 4, the heat-dissipating member 8 includes a first supporting surface 81, a second supporting surface 82, and a bottom face 83. The first and second supporting surfaces 81 and 82, and the bottom face 83, are oriented to opposite sides to each other, in the z-direction. The first supporting surface 81 and the second supporting surface 82 oriented upward in FIG. 4, and aligned in the y-direction. The second supporting surface 82 is located farther from the bottom face 83 (upper side in FIG. 4), with respect to the first supporting surface 81. The first supporting surface 81 is inclined with respect to the second supporting surface 82. To the first supporting surface 81, the heat-generating substrate reverse face 12 of the heat-generating substrate 1, and the first substrate reverse face 52 of the first substrate 5 are bonded. To the second supporting surface 82, the second substrate reverse face 62 of the second substrate 6 is bonded via the third substrate 7. The bottom face 83 is oriented downward in FIG. 4. The bottom face 83 serves as a reference when the thermal print head A1 is incorporated in a printer. The second supporting surface 82 is parallel to the bottom face 83. In other words, the first supporting surface 81 is inclined with respect to the bottom face 83. The first supporting surface 81 is orthogonal to the z-direction. In contrast, the second supporting surface 82 is inclined with respect to a plane orthogonal to the z-direction (first supporting surface 81), instead of being orthogonal to the z-direction. The second supporting surface 82 and the bottom face 83 are parallel to each other. Therefore, the bottom face 83 is not orthogonal to the z-direction.

The first supporting surface 81 is inclined with respect to the bottom face 83, by an angle β. In this embodiment, it is intended that the second slanting face 142 defines an angle of 26° with respect to the bottom face 83 (reference plane) of the heat-dissipating member 8, and therefore the angle β is set to 4°. Thus, the second slanting face 142 is inclined with respect to the heat-generating substrate obverse face 11 by the angle α2 (30°), and the heat-generating substrate obverse face 11 and the heat-generating substrate reverse face 12 are parallel to each other. The first supporting surface 81, to which the heat-generating substrate reverse face 12 is bonded, is inclined with respect to the bottom face 83 by the angle β (4°). The inclination direction of the first supporting surface 81 with respect to the bottom face 83 is opposite to the inclination direction of the second slanting face 142 with respect to the heat-generating substrate reverse face 12. Therefore, the angle defined by the second slanting face 142 with respect to the bottom face 83 (reference plane) of the heat-dissipating member 8 becomes 26° (=30°−4°). The angle β is not specifically limited, but may be set as the case may be. The angle β may be 0°, in other words, the first supporting surface 81 may be parallel to the bottom face 83.

Hereunder, an exemplary manufacturing method of the thermal print head A1 will be described, with reference to FIG. 7 to FIG. 16.

Figure 7:
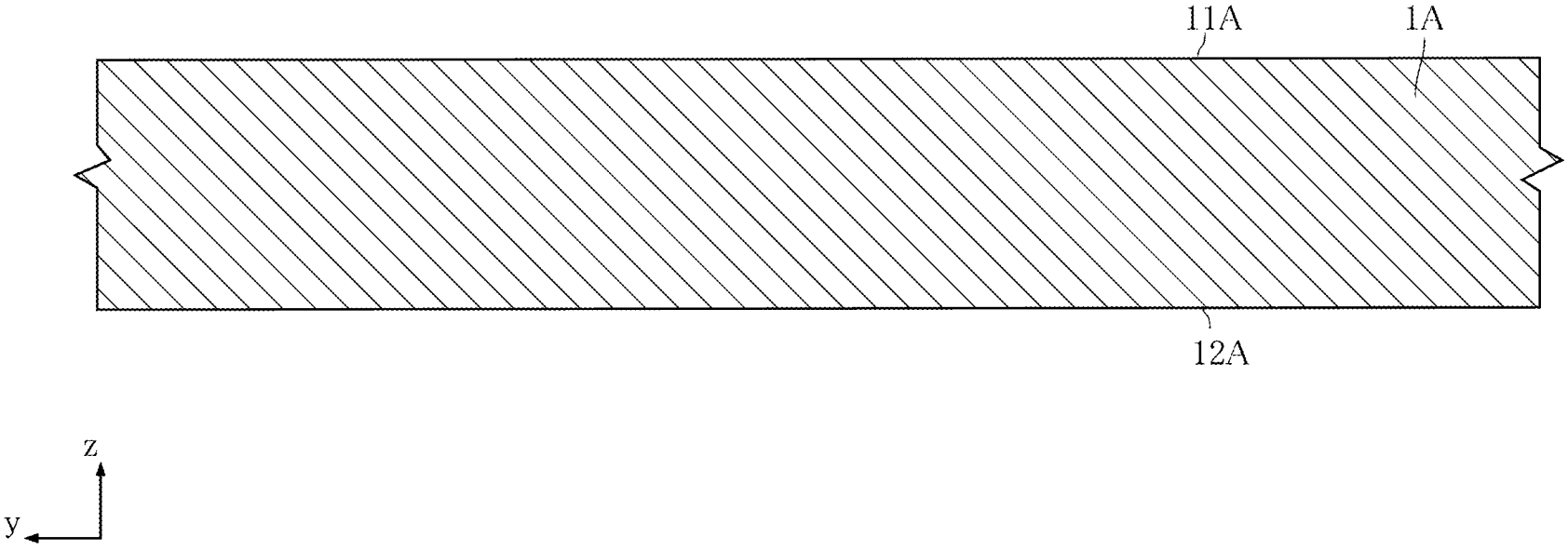
FIG. 7 is a partial cross-sectional view for explaining an exemplary manufacturing method of the thermal print head shown in FIG. 1.

Referring to FIG. 7, a substrate material 1A is prepared. The substrate material 1A is made of a monocrystalline semiconductor, for example a Si wafer. The substrate material 1A includes an obverse face 11A and a reverse face 12A oriented to opposite sides to each other. The obverse face 11A is a (100) plane.

Figure 8:
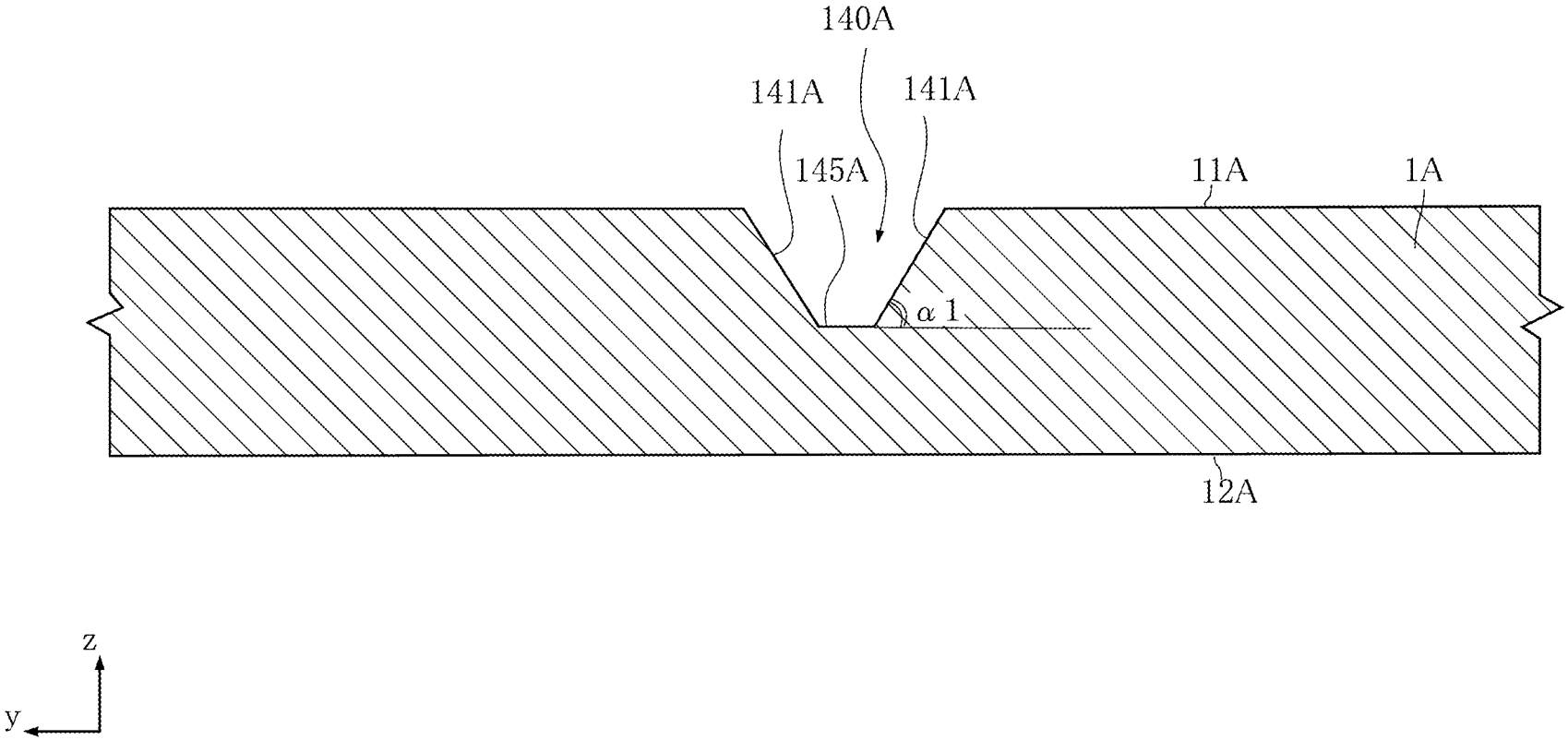
FIG. 8 is a partial cross-sectional view for explaining the exemplary manufacturing method of the thermal print head shown in FIG. 1.

Then the obverse face 11A is subjected to an anisotropic etching process, for example using potassium hydroxide (KOH), after being covered with a predetermined mask layer. As result, a recess 140A is formed in the substrate material 1A, as shown in FIG. 8. The recess 140A is concave from the obverse face 11A toward the reverse face 12A, and elongate in the x-direction. The recess 140A includes a bottom face 145A and a pair of slanting faces 141A. The bottom face 145A is parallel to the obverse face 11A and, in this embodiment, a (100) plane. The pair of slanting faces 141A are located on the respective sides of the bottom face 145A in the y-direction, and each interposed between the bottom face 145A and the obverse face 11A. The slanting faces 141A are flat faces inclined with respect to the bottom face 145A and the obverse face 11A. In this embodiment, the angle α1 defined between the slanting face 141A, and the obverse face 11A and bottom face 145A is 54.7°.

Figure 9:
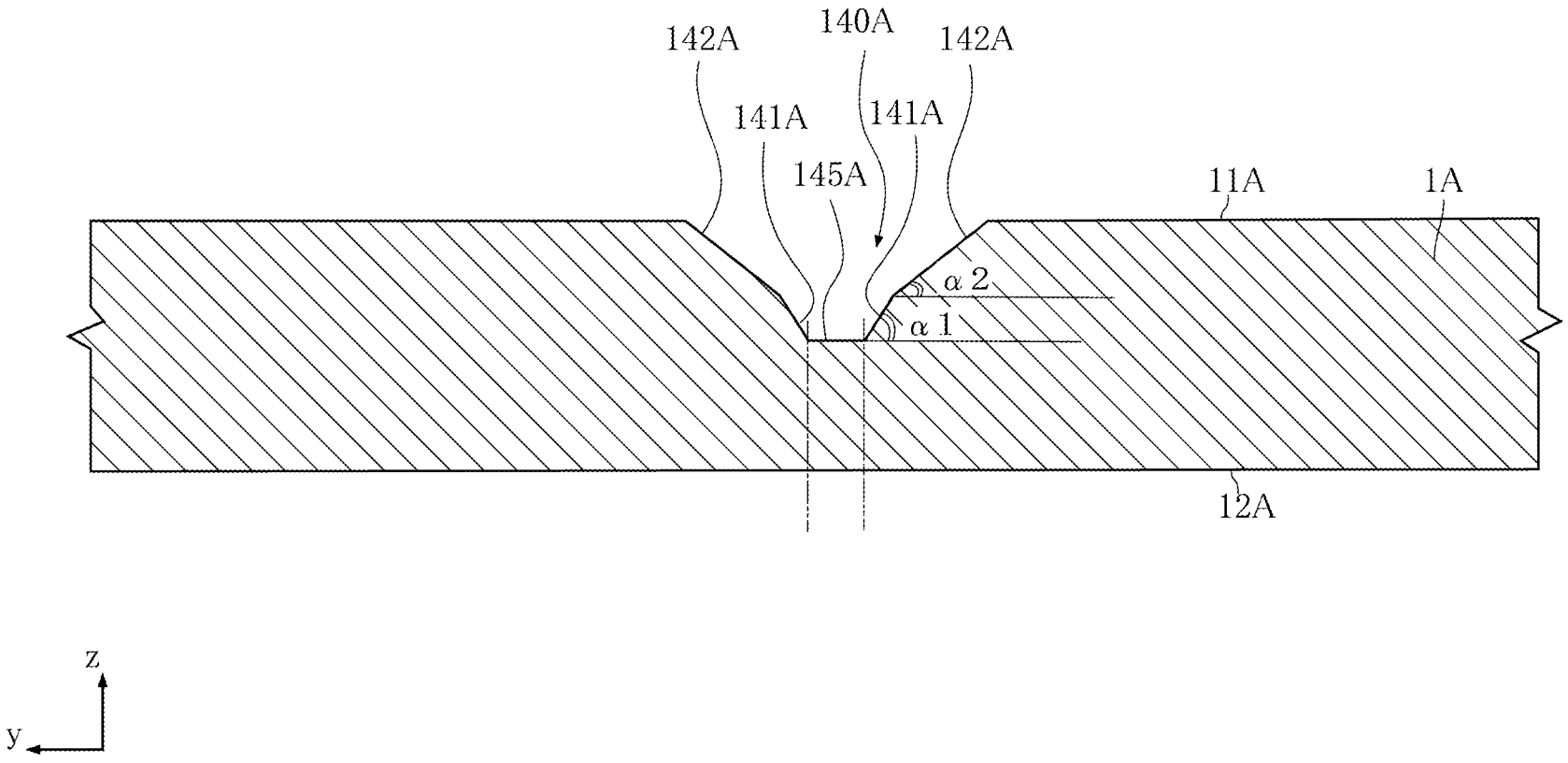
FIG. 9 is a partial cross-sectional view for explaining the exemplary manufacturing method of the thermal print head shown in FIG. 1.

After the mask layer is removed, an overall etching process is performed, for example using tetramethylammonium hydroxide (TMAH). As result, another pair of slanting faces 142A are formed in the recess 140A, as shown in FIG. 9. The pair of slanting faces 142A are located on the respective sides of the bottom face 145A in the y-direction, and each interposed between the slanting face 141A and the obverse face 11A. The slanting faces 142A are flat faces inclined with respect to the bottom face 145A and the obverse face 11A. In this embodiment, the angle α2 defined between the slanting face 142A, and the obverse face 11A and bottom face 145A is 30°.

Figure 10:
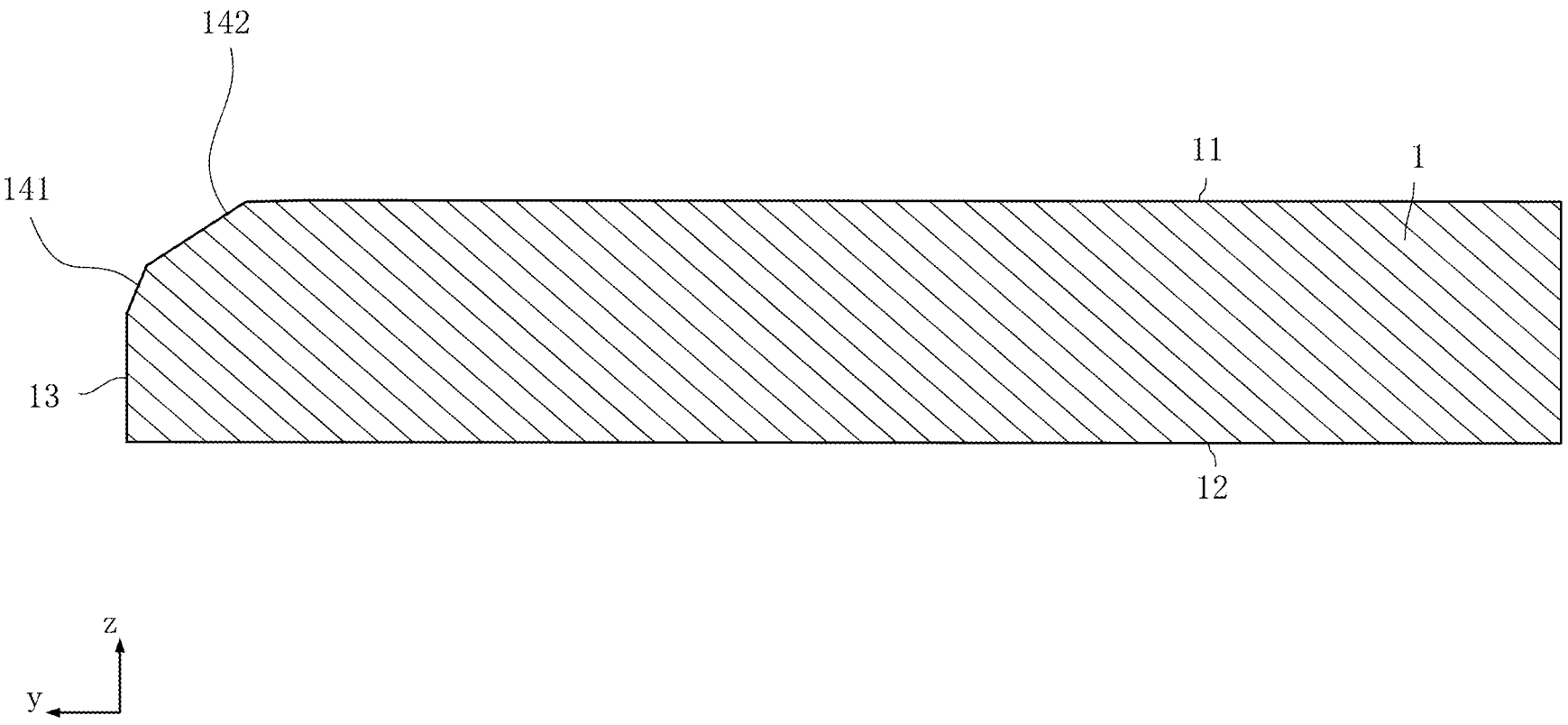
FIG. 10 is a partial cross-sectional view for explaining the exemplary manufacturing method of the thermal print head shown in FIG. 1.

Then the substrate material 1A is cut into individual pieces, each of which is formed into the heat-generating substrate 1, as shown in FIG. 10. The heat-generating substrate obverse face 11 corresponds to the portion that was the obverse face 11A, and the heat-generating substrate reverse face 12 corresponds to the portion that was the reverse face 12A. The first slanting face 141 corresponds to the portion that was the slanting face 141A, and the second slanting face 142 corresponds to the portion that was the slanting face 142A. By cutting the substrate material 1A at positions indicated by dash-dot-dot lines in FIG. 9, the heat-generating substrate end face 13 connected to the first slanting face 141 and the heat-generating substrate reverse face 12 can be formed as shown in FIG. 10.

Figure 11:
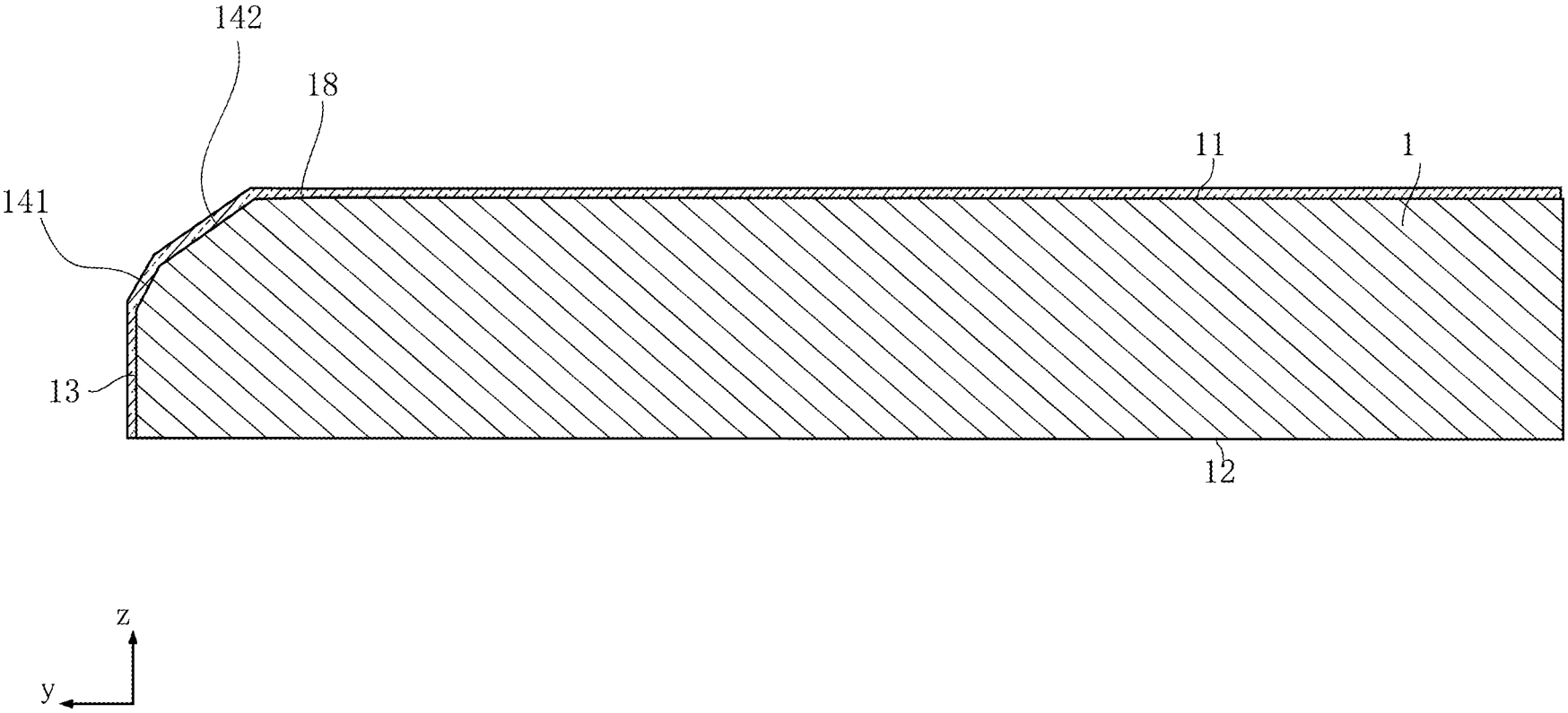
FIG. 11 is a partial cross-sectional view for explaining the exemplary manufacturing method of the thermal print head shown in FIG. 1.

Proceeding to FIG. 11, the insulation layer 18 is formed. To form the insulation layer 18, TEOS is deposited on the heat-generating substrate obverse face 11, the heat-generating substrate end face 13, the first slanting face 141, and the second slanting face 142, for example through a CVD process.

Figure 12:
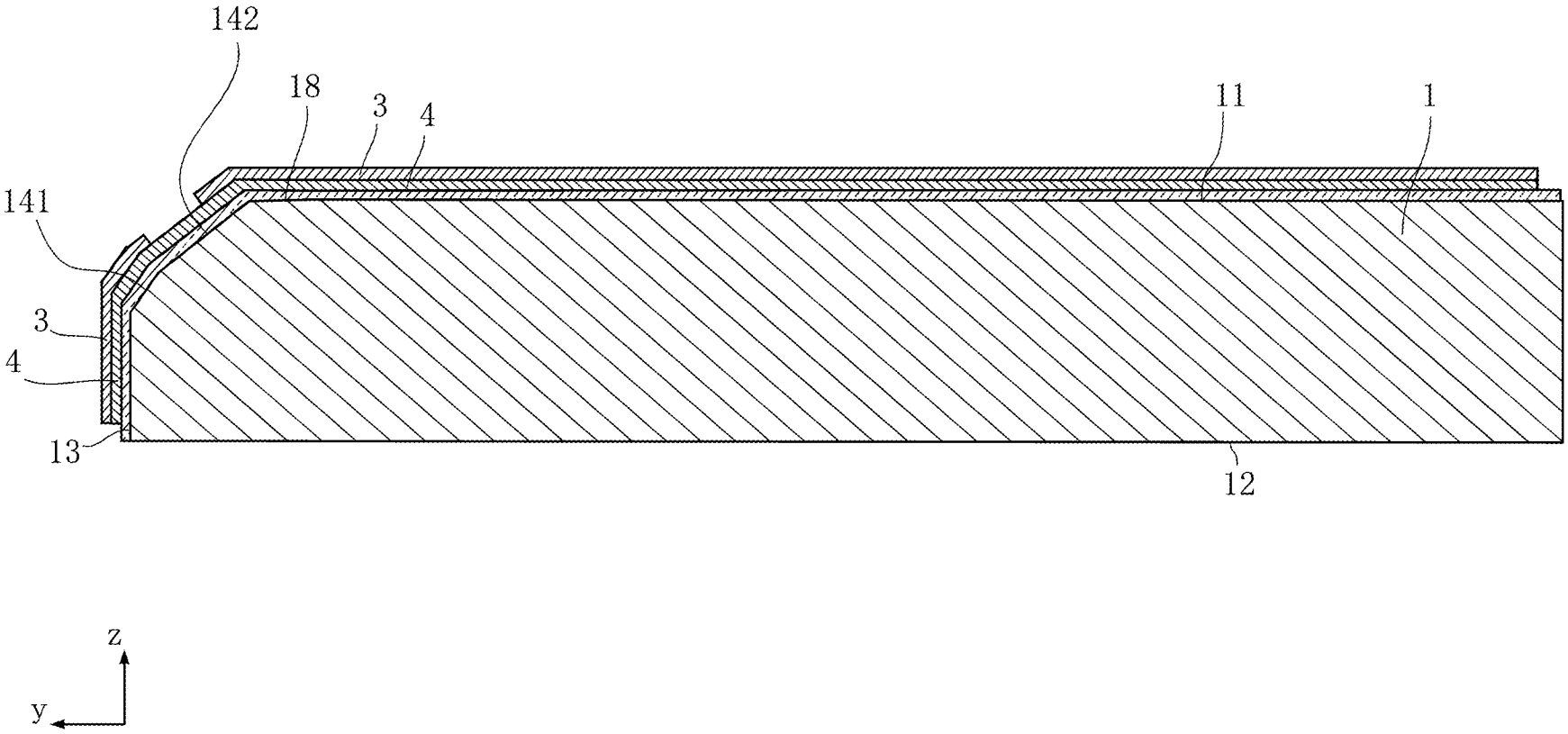
FIG. 12 is a partial cross-sectional view for explaining the exemplary manufacturing method of the thermal print head shown in FIG. 1.

Proceeding to FIG. 12, the resistor layer 4 and the conductive layer 3 are formed. First, a resistor film is formed. To form the resistor film, a thin film of TaN is formed on the insulation layer 18, for example by a sputtering process. Then a conductive film is formed so as to cover the resistor film. To form the conductive film, a layer of Cu is formed, for example by a plating process or sputtering process. Then the conductive film and the resistor film are subjected to selective etching process, so that the conductive layer 3 and the resistor layer 4 are obtained.

Then the protective layer 2 is formed. To form the protective layer 2, SiN and SiC are deposited on the insulation layer 18, the conductive layer 3, and the resistor layer 4, for example through a CVD process. In addition, the protective layer 2 is partially removed, for example by etching, to form the opening for pad 21. Through the foregoing process, the heat-generating substrate 1 having the mentioned layers formed thereon can be obtained.

Apart from the processing of the heat-generating substrate 1, the first substrate 5, the second substrate 6, and the third substrate 7 are assembled. The first substrate 5 is a PCB substrate having the first wiring, and the thermistor 58 and the capacitor 59 are mounted on the first substrate 5. The is a PCB substrate having the second wiring and the through-hole 63, and other circuit elements and the connector 69 are mounted on the second substrate 6. The third substrate 7 is a flexible print substrate on which the third wiring is formed.

Figure 13:
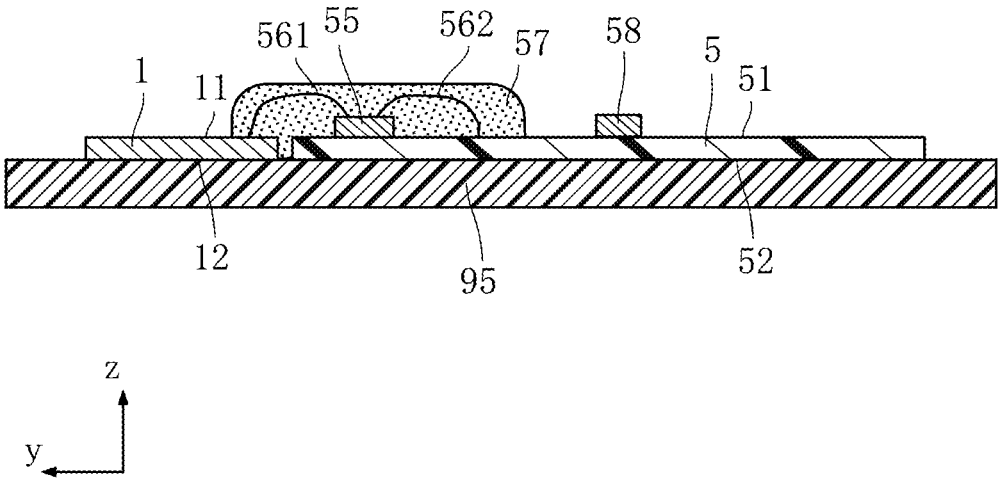
FIG. 13 is a partial cross-sectional view for explaining the exemplary manufacturing method of the thermal print head shown in FIG. 1.

Referring to FIG. 13, the heat-generating substrate 1 and the first substrate 5 are combined. First, the heat-generating substrate 1 and the first substrate 5 are arranged on a support tape 95, with a predetermined spacing therebetween. Then the driver IC 55 is mounted on the first substrate obverse face 51 of the first substrate 5, and the plurality of wires 561 and 562 are bonded. Thereafter, the protective resin 57 is formed.

Figure 14:
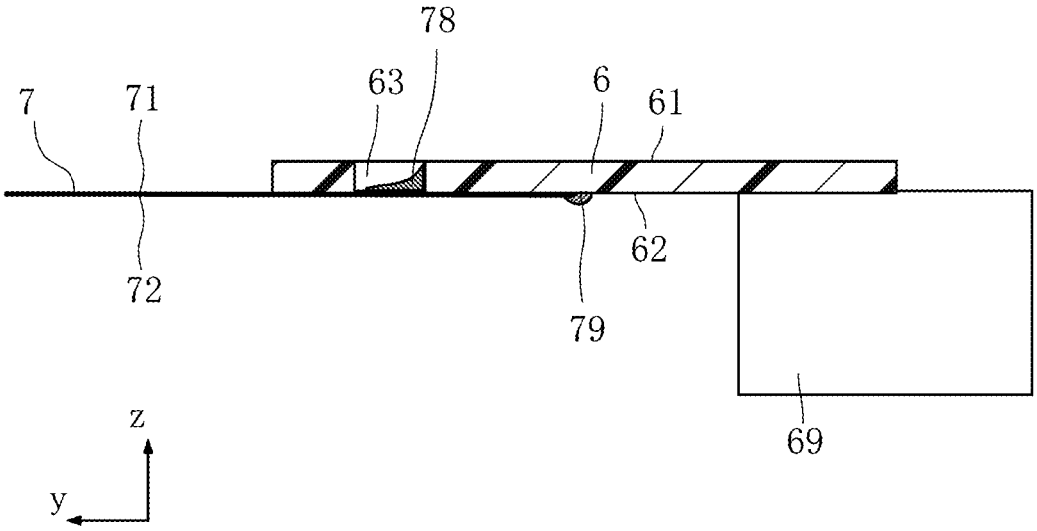
FIG. 14 is a partial cross-sectional view for explaining the exemplary manufacturing method of the thermal print head shown in FIG. 1.

Proceeding to FIG. 14, the second substrate 6 and the third substrate 7 are combined. First, the portion of the third obverse face 71 of the third substrate 7 on the upstream side in the y-direction is bonded to the reverse face 62 of the second substrate 6, with an adhesive or the like. Then the bonding reinforcement member 79 is formed so as to stride over the end portion of the third reverse face 72 on the upstream side in the y-direction and the second substrate reverse face 62. Thereafter, the bonding reinforcement member 78 is formed, in contact with the inner wall of the through-hole 63 of the second substrate 6, and the third obverse face 71. The bonding reinforcement member 78 may be formed, after the second substrate 6 is attached to the heat-dissipating member 8.

Then the portion of the third reverse face 72 of the third substrate 7 on the downstream side in the y-direction is bonded to the first substrate obverse face 51 of the first substrate 5, separated from the support tape 95, with an adhesive or the like. Thereafter, the bonding reinforcement member 77 is formed so as to stride over the end portion of the third obverse face 71 on the downstream side in the y-direction and the first substrate obverse face 51. The bonding reinforcement member 76 is the formed, in contact with the end face of the first substrate 5 on the upstream side in the y-direction, and the third reverse face 72.

At the next stage, the thermal print head A1 is assembled as follows.

Figure 15:
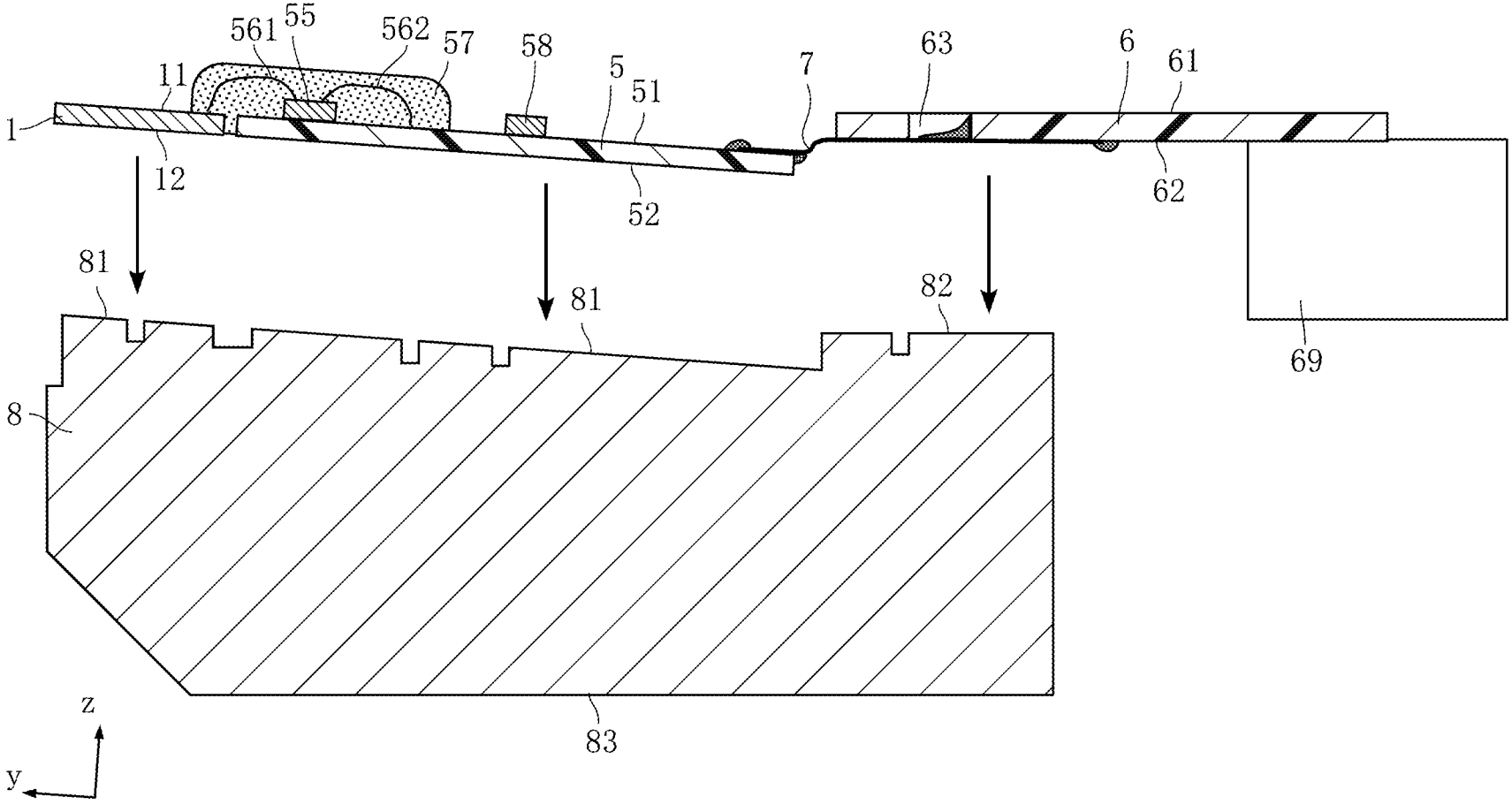
FIG. 15 is a partial cross-sectional view for explaining the exemplary manufacturing method of the thermal print head shown in FIG. 1.

First, the heat-dissipating member 8, on which the first supporting surface 81, the second supporting surface 82, and the bottom face 83 are formed, is prepared. The heat-dissipating member 8 is formed by extrusion molding, from a metal material such as aluminum. As shown in FIG. 15, the heat-generating substrate 1, the first substrate 5, and the second substrate 6, which are now unified, are attached to the heat-dissipating member 8. The heat-generating substrate 1 is set on the portion of the first supporting surface 81 on the downstream side in the y-direction, with the heat-generating substrate reverse face 12 opposed to the first supporting surface 81, and the first substrate 5 is set on the portion of the first supporting surface on the upstream side in the y-direction, with the first substrate reverse face 52 opposed to the first supporting surface 81. The second substrate 6 is set on the second supporting surface 82, with the second substrate reverse face 62 opposed thereto. Since the first substrate 5 is connected to the second substrate 6 via the third substrate 7 which is flexible, the inclined posture of the first substrate 5 can be freely adjusted, with respect to the second substrate 6. Therefore, the first substrate 5 can be attached to the first supporting surface 81, which is inclined with respect to the second supporting surface 82. Through the process described thus far, the thermal print head A1 can be obtained.

Hereunder, the advantages of the thermal print head A1 will be described.

In this embodiment, the first substrate 5 and the second substrate 6 are bonded to the third substrate 7, having high flexibility. Accordingly, the first substrate 5 and the second substrate 6 can be mounted on the heat-dissipating member 8, in an inclined posture with respect to each other. Therefore, the degree of freedom in designing the thermal print head A1 can be improved.

In this embodiment, the Au-plated layer of high purity is formed on the first wiring of the first substrate 5. In contrast, the Au-plated layer is not provided on the second wiring of the second substrate 6, and therefore the manufacturing cost of the second substrate 6 is lower than that of the first substrate 5. In other words, in this embodiment two types of substrates, namely the first substrate 5 that requires the expensive plating, and the second substrate 6 for which the inexpensive plating is sufficient, are employed according to the purpose of use. Therefore, an increase in manufacturing cost can be suppressed, compared with the case where a single substrate is employed, because in this case all the circuit elements are mounted on the same substrate, and therefore the expensive plating has to be applied to the entirety of the substrate.

In this embodiment, the first substrate 5 and the second substrate 6 are both PCB substrates. Therefore, the mounting density and the mounting accuracy of the circuit elements can be improved, compared with the case where either or both of the first substrate 5 and the second substrate 6 are configured as the flexible print substrate.

In this embodiment, the thermistor 58 is mounted on the first substrate obverse face 51, at a position upstream of the driver IC 55 in the y-direction and in the vicinity of the protective resin 57 (see FIG. 4). Since the thermistor 58 is located close to the driver IC 55, an increase in temperature resultant from the heat generated by the driver IC 55 can be accurately detected. Accordingly, the thermal runaway of the driver IC 55 can be prevented. Further, since the thermistor 58 is located as close as possible to the heat-generating substrate 1, the thermal history of the heat-generating substrate 1 can be recorded with higher accuracy. In this embodiment, the capacitor 59 is mounted on the first substrate obverse face 51, and can be located in the vicinity of the driver IC 55.

In this embodiment, the third obverse face 71 of the third substrate 7 is bonded to the second substrate reverse face 62, and the third reverse face 72 is bonded to the first substrate obverse face 51. Such a configuration allows the bending range 75 of the third substrate 7 (see FIG. 6) to be broader, compared with the case of bonding the third obverse face 71 to the first substrate reverse face 52 and the second substrate reverse face 62, or bonding the third reverse face 72 to the first substrate obverse face 51 and the second substrate obverse face 61. In addition, the bonding reinforcement member 78 is provided in the through-hole 63. Therefore, the bending range 75 of the third substrate 7 can be extended, compared with the case where the bonding reinforcement member 78 is formed on the end face of the second substrate 6. Further, as shown in FIG. 4, the second supporting surface 82 of the heat-dissipating member 8 is spaced apart from the first supporting surface 81 (to the upper side in FIG. 4), in the z-direction. Such a configuration is convenient for mounting the first substrate 5 and the second substrate 6 on the heat-dissipating member 8.

In this embodiment, the angle $\alpha 1$ (see FIG. 5) is 54.7°, and the angle $\alpha 2$ is 30°. These angles can be accurately realized, through an anisotropic etching process on the (100) plane of Si. Accordingly, the angle of the heating element 41 located on the second slanting face 142, with respect to the heat-generating substrate obverse face 11, can be accurately realized. In addition, since the heat-dissipating member 8 is formed by extrusion molding, the angle $\beta$ (see FIG. 5) can be accurately realized. Therefore, the intended angle between the second slanting face 142 (heating element 41) of the heat-generating substrate 1 mounted on the first supporting surface 81, and the bottom face 83 of the heat-dissipating member 8, can be accurately realized. Further, the angle between the second slanting face 142 (heating element 41) and the bottom face 83 can be set to a desired angle, by adjusting the angle $\beta$.

FIG. 16 to FIG. 25 illustrate other embodiments of the present disclosure. In these drawings, the elements same as or similar to those of the first embodiment are given the same numeral.

Figure 16:
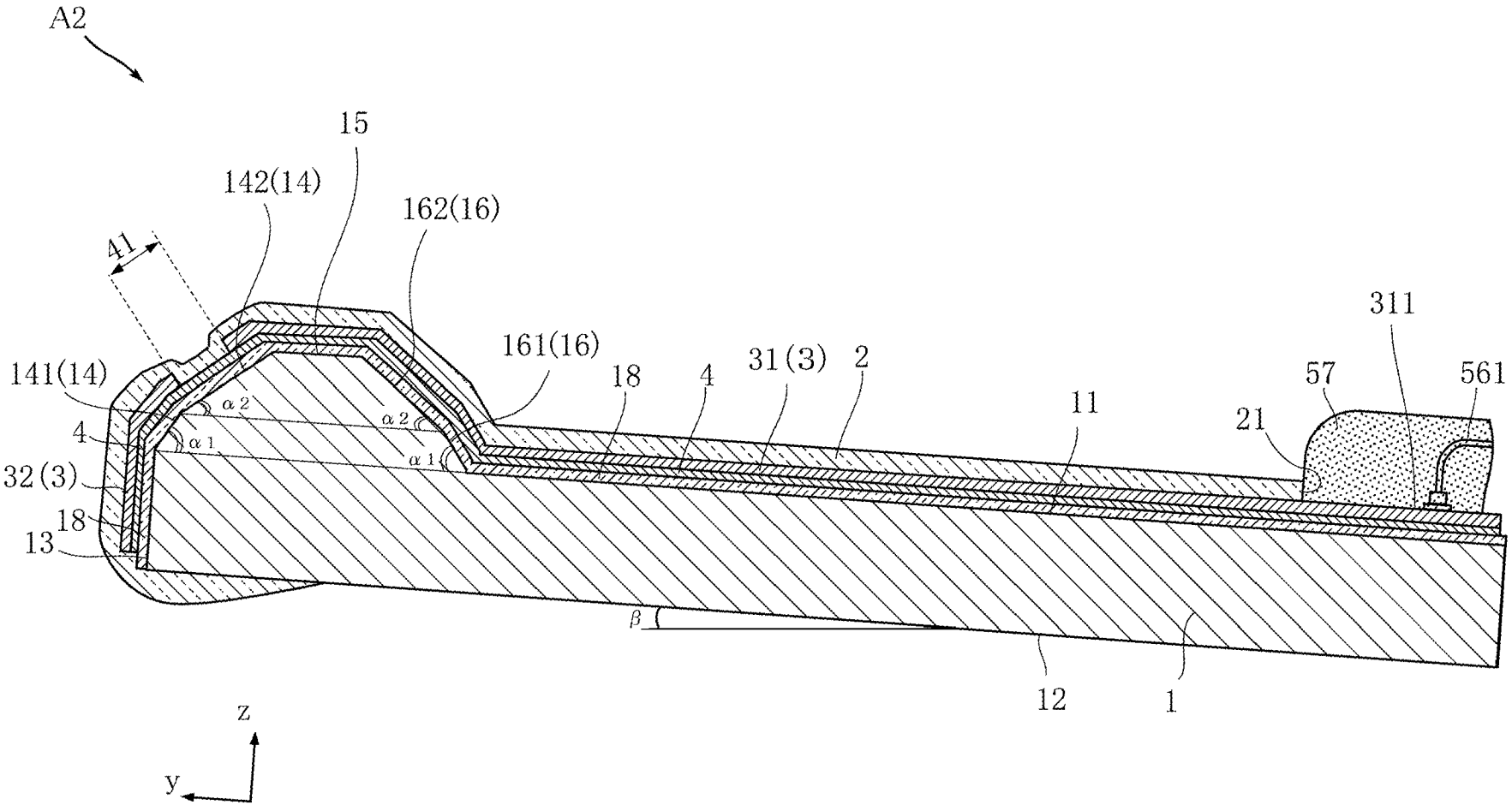
FIG. 16 is a partial cross-sectional view showing a thermal print head according to a second embodiment.

FIG. 16 is a partial cross-sectional view of a thermal print head according to a second embodiment, showing the portion corresponding to FIG. 5. The thermal print head A2 shown in FIG. 16 is different from the thermal print head A1, in the shape of the heat-generating substrate 1.

In this embodiment, the heat-generating substrate 1 includes a heat-generating substrate top face 15 and a heat-generating substrate slanting face 16. The heat-generating substrate top face 15 is oriented to the same side as is the heat-generating substrate obverse face 11, and parallel thereto. The heat-generating substrate top face 15 is located upstream of the heat-generating substrate slanting face 14 in the y-direction, and connected to the second slanting face 142. The heat-generating substrate top face 15 is a rectangular flat face, elongate in the x-direction, when viewed in the z-direction.

The heat-generating substrate slanting face 16 is connected to the heat-generating substrate obverse face 11 and the heat-generating substrate top face 15. The heat-generating substrate slanting face 16 is inclined with respect to the heat-generating substrate obverse face 11 and the heat-generating substrate top face 15. The heat-generating substrate slanting face 16 includes a third slanting face 161 and a fourth slanting face 162. The third slanting face 161 is connected to the heat-generating substrate obverse face 11. The boundary between the third slanting face 161 and the heat-generating substrate obverse face 11 has a concave shape. The fourth slanting face 162 is connected to the heat-generating substrate top face 15. The boundary between the fourth slanting face 162 and the heat-generating substrate top face 15 has a convex shape. The fourth slanting face 162 is inclined with respect to the third slanting face 161, and the boundary between the third slanting face 161 and the fourth slanting face 162 has a convex shape. The third slanting face 161 is inclined with respect to the heat-generating substrate obverse face 11, by the angle $\alpha 1$. The fourth slanting face 162 is inclined with respect to the heat-generating substrate obverse face 11, y the angle $\alpha 2$. The third slanting face 161 and the fourth slanting face 162 are flat faces of an elongate rectangular shape, extending in the x-direction, when viewed in the z-direction.

Figure 17:
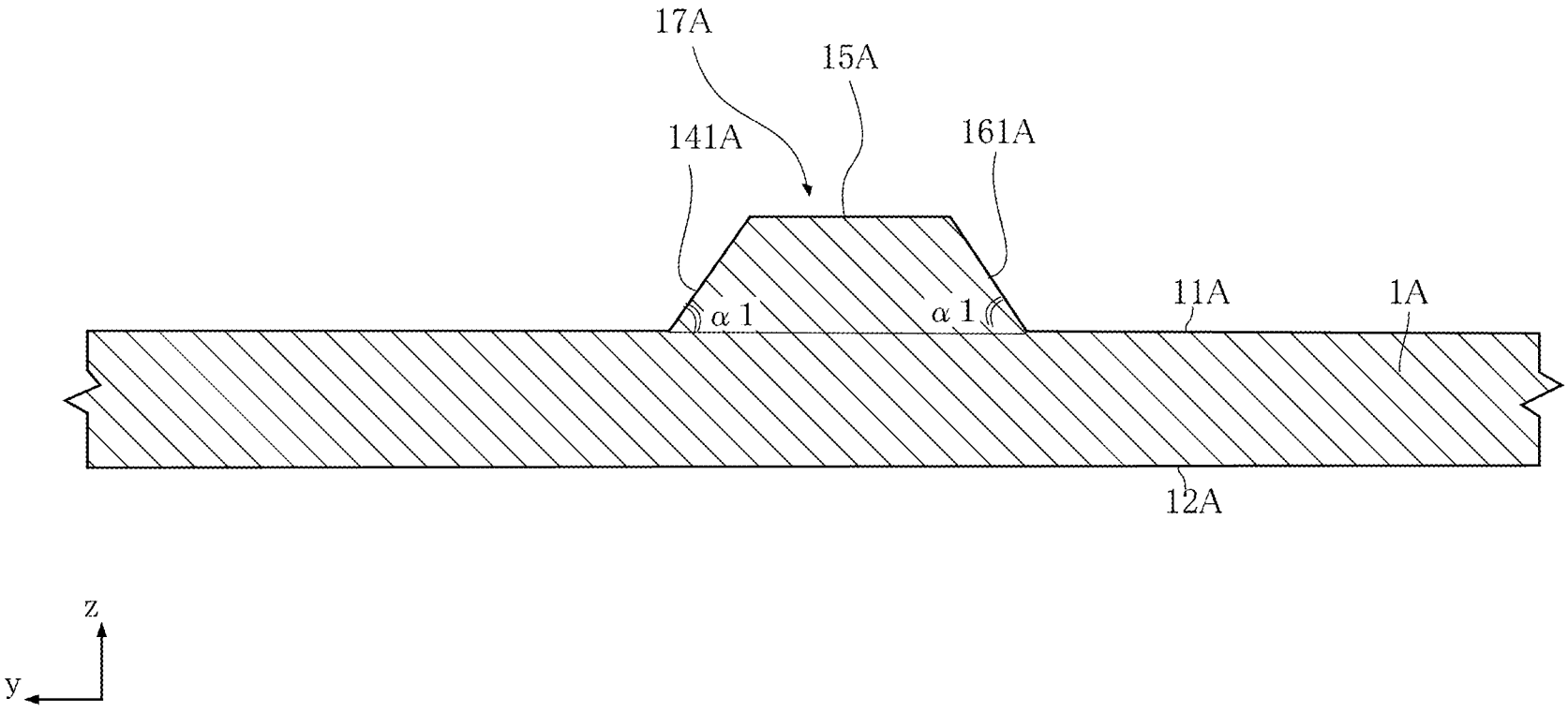
FIG. 17 is a partial cross-sectional view for explaining an exemplary manufacturing method of the thermal print head shown in FIG. 16.

The heat-generating substrate 1 is formed through the anisotropic etching process, like the heat-generating substrate 1 according to the first embodiment. First, the substrate material 1A is prepared as shown in FIG. 7. Then the obverse face 11A is subjected to the anisotropic etching process, for example using potassium hydroxide (KOH), after being covered with a predetermined mask layer. As result, a protrusion 17A is formed on the substrate material 1A, as shown in FIG. 17. The protrusion 17A is convex from the obverse face 11A in the z-direction, and elongate in the x-direction. The protrusion 17A includes a top face 15A and a pair of slanting faces 141A and 161A. The top face 15A is parallel to the obverse face 11A, and is a (100) plane. The slanting face 141A is located downstream of the top face 15A in the y-direction, and interposed between the top face 15A and the obverse face 11A. The slanting face 161A is located upstream of the top face 15A in the y-direction, and interposed between the top face 15A and the obverse face 11A. The slanting faces 141A and 161A are both flat faces inclined with respect to the top face 15A and the obverse face 11A.

Figure 18:
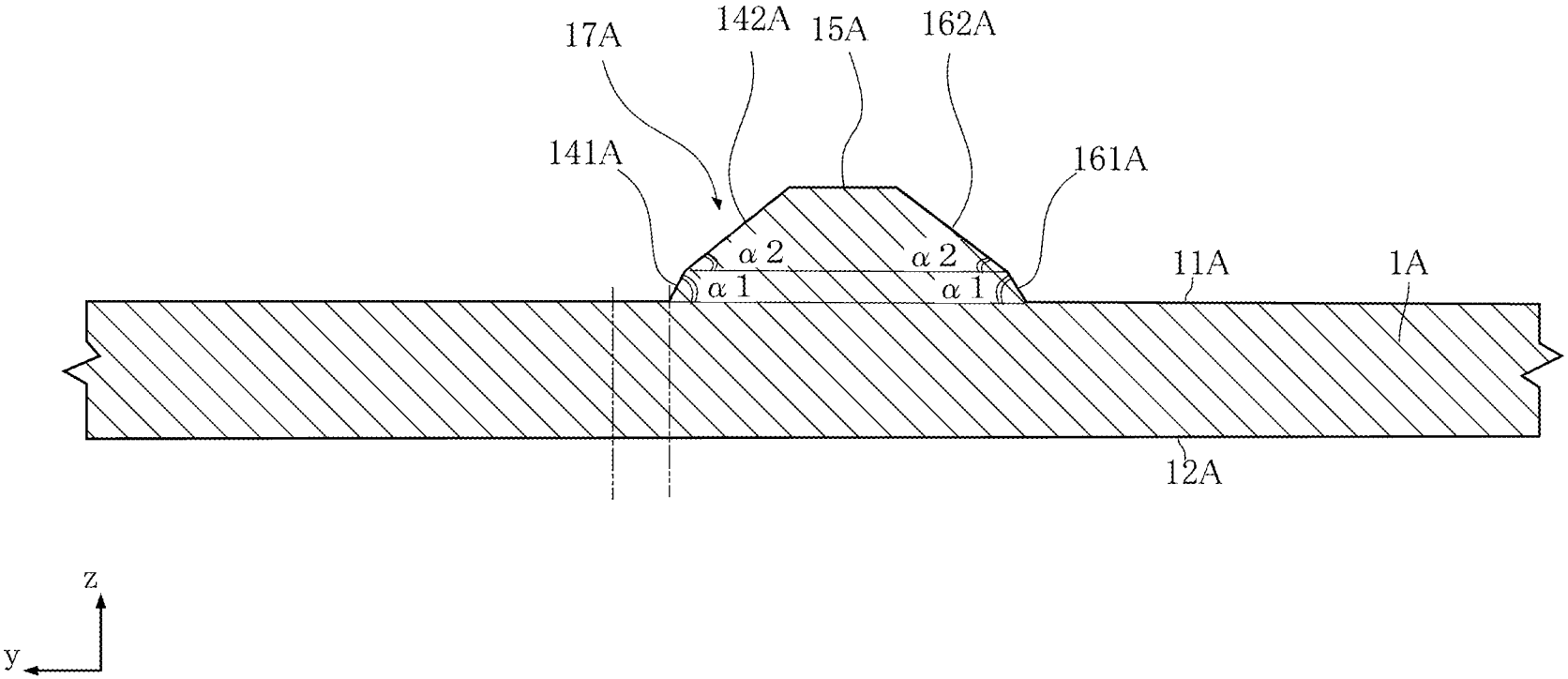
FIG. 18 is a partial cross-sectional view for explaining the exemplary manufacturing method of the thermal print head shown in FIG. 16.

After the mask layer is removed, the overall etching process is performed, for example using tetramethylammonium hydroxide (TMAH). As result, another pair of slanting faces 142A and 162A are formed on the protrusion 17A, as shown in FIG. 18. The slanting face 142A is located downstream of the top face 15A in the y-direction, and interposed between the top face 15A and the slanting face 141A. The slanting face 162A is located upstream of the top face 15A in the y-direction, and interposed between the top face 15A and the slanting face 161A. The slanting faces 142A and 162A are both flat faces inclined with respect to the top face 15A and the obverse face 11A.

Then the substrate material 1A is cut into the individual pieces, at the position indicated by dash-dot-dot lines in FIG. 18, thus to be formed into the heat-generating substrate 1 shown in FIG. 16. The heat-generating substrate obverse face 11 corresponds to the portion that was the obverse face 11A, and the heat-generating substrate reverse face 12 corresponds to the portion that was the reverse face 12A. The first slanting face 141 corresponds to the portion that was the slanting face 141A, and the second slanting face 142 corresponds to the portion that was the slanting face 142A. The heat-generating substrate top face 15 corresponds to the portion that was the top face 15A. The third slanting face 161 corresponds to the portion that was the slanting face 161A, and the fourth slanting face 162 corresponds to the portion that was the slanting face 162A. The cut sections along the dash-dot-dot lines in FIG. 16 correspond to the heat-generating substrate end face 13.

The insulation layer 18 covers the heat-generating substrate obverse face 11, the heat-generating substrate end face 13, the heat-generating substrate slanting face 14, the heat-generating substrate top face 15, and the heat-generating substrate slanting face 16. The resistor layer 4, the plurality of individual electrodes 31, and the protective layer 2 are also formed on the heat-generating substrate top face 15 and the heat-generating substrate slanting face 16.

In this embodiment also, the first substrate 5 and the second substrate 6 are bonded to the third substrate 7, which has high flexibility. Therefore, the same advantages as those provided by the first embodiment can be attained.

Figure 19:
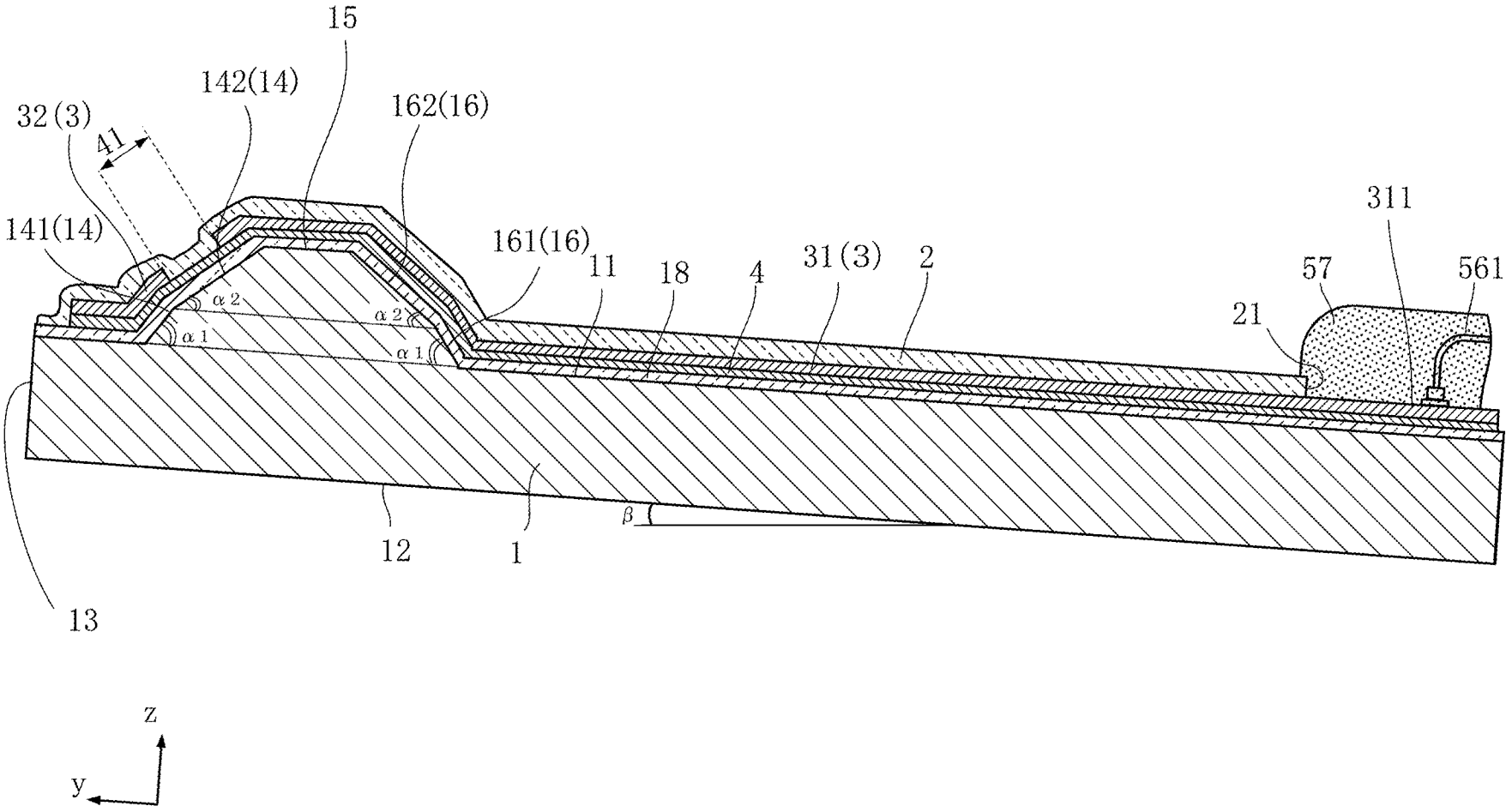
FIG. 19 is a partial cross-sectional view showing a thermal print head according to a third embodiment.

FIG. 19 is a partial cross-sectional view of a thermal print head according to a third embodiment, showing the portion corresponding to FIG. 5. The thermal print head A3 shown in FIG. 19 is different from the thermal print head A2, in the shape of the heat-generating substrate 1.

In the heat-generating substrate 1 according to this embodiment, the protrusion including the heat-generating substrate slanting face 14, the heat-generating substrate top face 15, and the heat-generating substrate slanting face 16 is shifted to the upstream side in the y-direction, compared with the heat-generating substrate 1 according to the second embodiment. The heat-generating substrate 1 configured as above can be obtained by shifting the cutting position (dash-dot-dot line in FIG. 18) to the downstream side in the y-direction, in the manufacturing process of the heat-generating substrate 1 according to the second embodiment (see FIG. 18).

The insulation layer 18, the resistor layer 4, the conductive layer 3, and the protective layer 2 are not formed on the heat-generating substrate end face 13 and the heat-generating substrate reverse face 12.

In this embodiment also, the first substrate 5 and the second substrate 6 are bonded to the third substrate 7, which has high flexibility. Therefore, the same advantages as those provided by the first embodiment can be attained.

Figure 20:
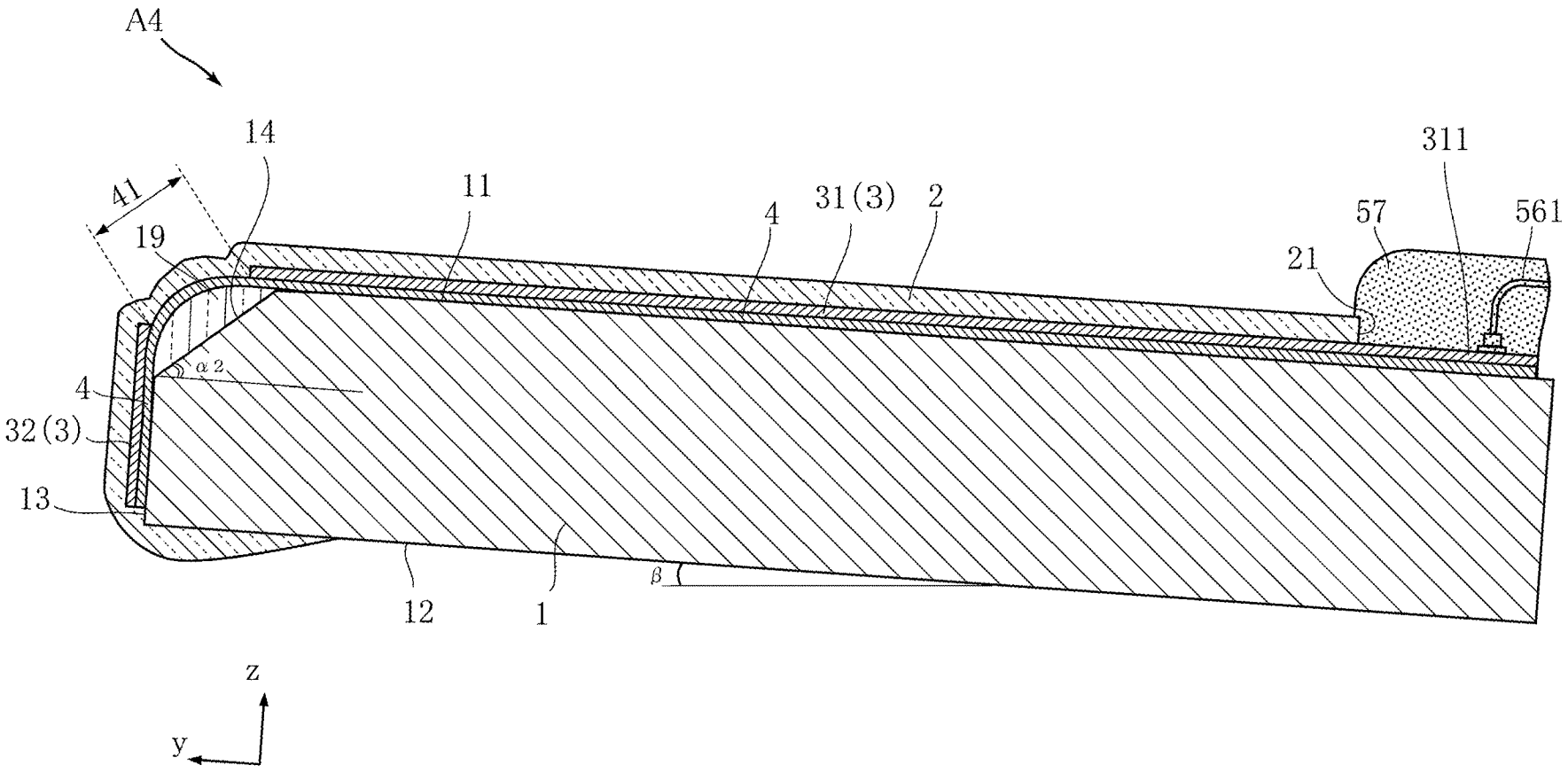
FIG. 20 is a partial cross-sectional view showing a thermal print head according to a fourth embodiment.

FIG. 20 is a partial cross-sectional view of a thermal print head according to a fourth embodiment, showing the portion corresponding to FIG. 5.

In this embodiment, the heat-generating substrate 1 is made of a ceramic. Since the ceramic is insulative, the thermal print head A4 is without the insulation layer 18 (see, for example, FIG. 19). The heat-generating substrate slanting face 14 is formed as a face inclined with respect to the heat-generating substrate obverse face 11, by the angle $\alpha 2$. The thermal print head A4 includes a glaze layer 19. The glaze layer 19 is formed on the heat-generating substrate slanting face 14. As shown in FIG. 20, a first face of the glaze layer 19 is flush with the heat-generating substrate obverse face 11, and a second face is flush with the heat-generating substrate end face 13. A third face of the glaze layer 19 is formed as a curved face connected to the first face and the second face. In the illustrated example, the third face is convex outwardly of the glaze layer 19. The glaze layer 19 is elongate in the x-direction. The glaze layer 19 is, for example, made of a glass material such as non-crystalline glass. The glaze layer 19 is formed by thick film printing of glass paste on the heat-generating substrate slanting face 14, and sintering the glass paste. The glaze layer 19 is interposed between the heating element 41 and the heat-generating substrate slanting face 14, and capable of accumulating the heat generated by the heating element 41. The resistor layer 4 covers at least a part of the glaze layer 19. The heating elements 41 are located on the glaze layer 19.

In this embodiment also, the first substrate 5 and the second substrate 6 are bonded to the third substrate 7, which has high flexibility. Therefore, the same advantages as those provided by the first embodiment can be attained. The heat-generating substrate slanting face 14 according to this embodiment can also be formed by a method other than the anisotropic etching on the (100) plane of Si.

Figure 21:
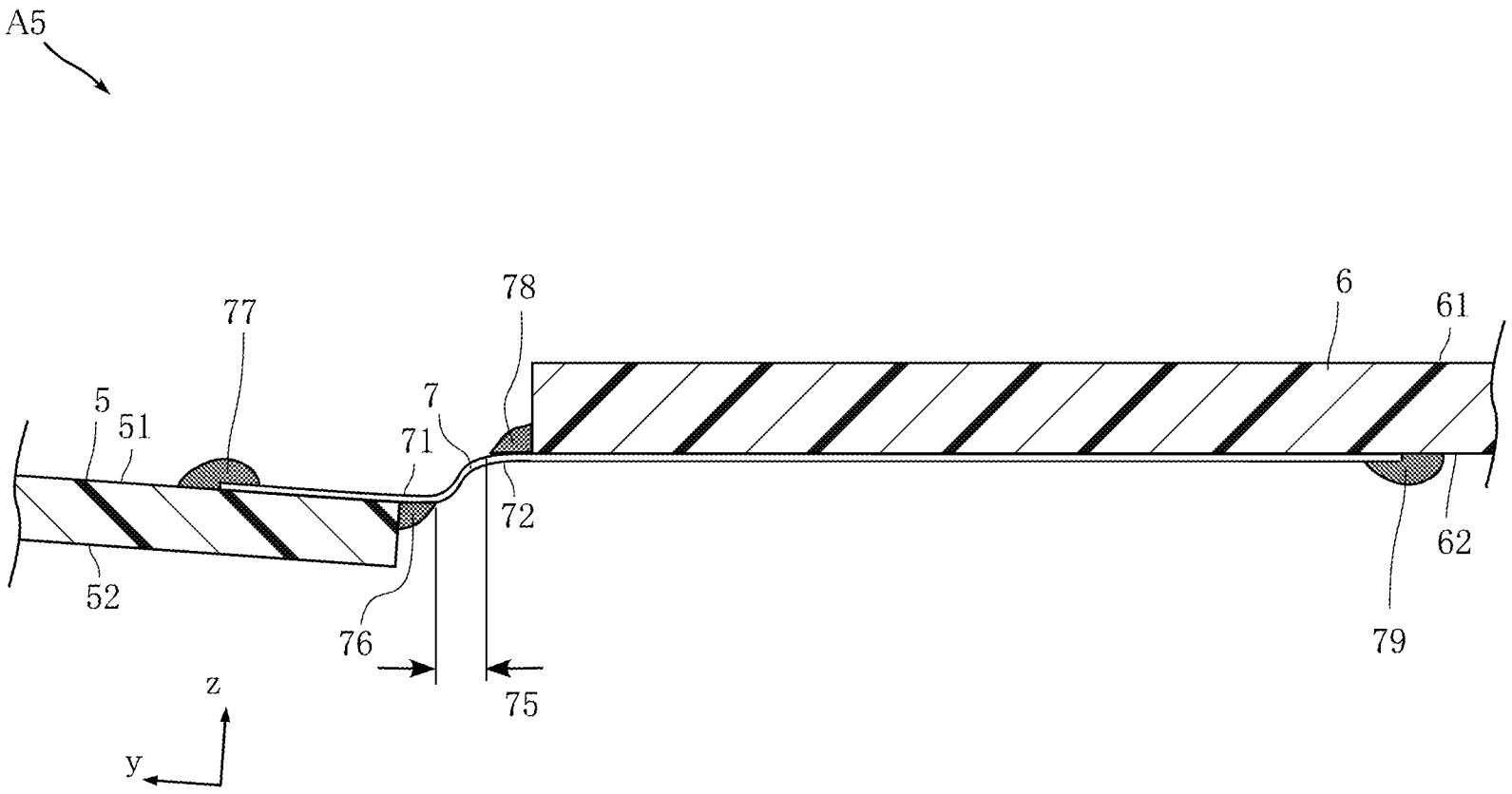
FIG. 21 is a partially enlarged cross-sectional view showing a thermal print head according to a fifth embodiment.

FIG. 21 is a partially enlarged cross-sectional view of a thermal print head according to a fifth embodiment, showing the portion corresponding to FIG. 6. In the thermal print head A5 shown in FIG. 21, the second substrate 6 is without the through-hole 63.

The second substrate 6 includes two end faces spaced apart from each other in the y-direction, namely the end face on the upstream side in the y-direction and the end face on the downstream side in the y-direction (see, for example, FIG. 4). In this embodiment, the bonding reinforcement member 78 is elongate in the x-direction, in contact with the third obverse face 71 and the end face (on the downstream side in the y-direction) of the second substrate 6 adjacent to the third obverse face.

In this embodiment also, the first substrate 5 and the second substrate 6 are bonded to the third substrate 7, which has high flexibility. Therefore, the same advantages as those provided by the first embodiment can be attained.

Figure 22:
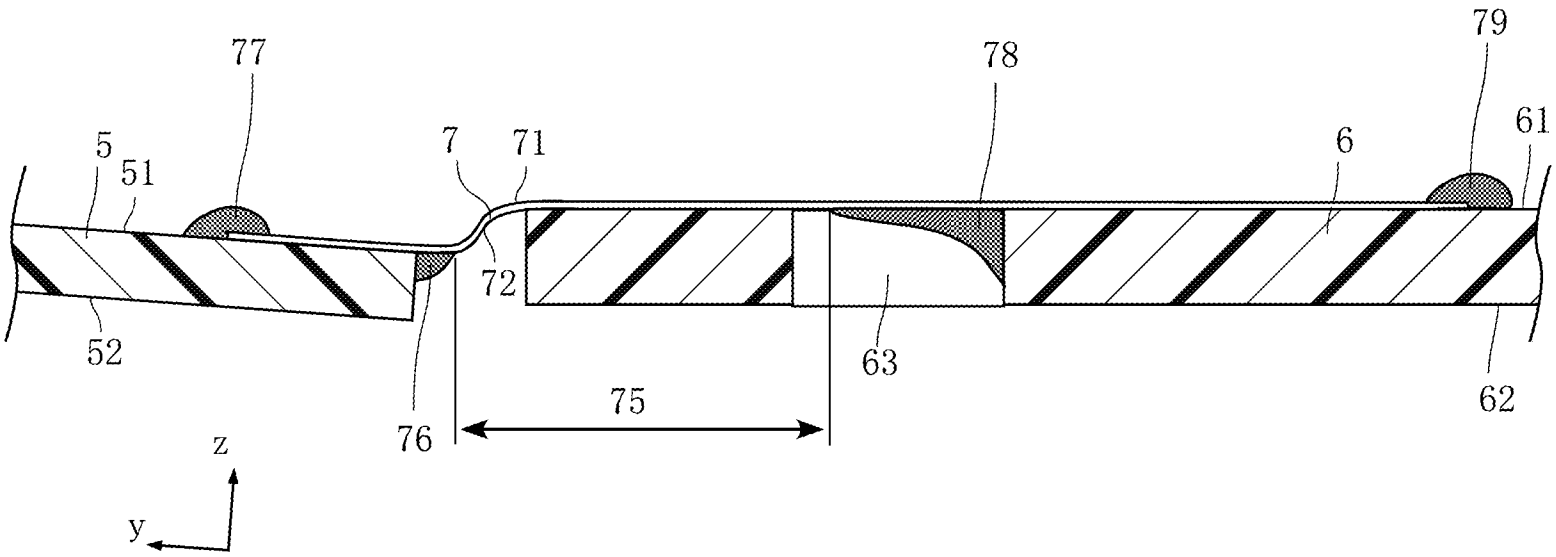
FIG. 22 is a partially enlarged cross-sectional view showing a thermal print head according to a sixth embodiment.

FIG. 22 is a partially enlarged cross-sectional view of a thermal print head according to a sixth embodiment, showing the portion corresponding to FIG. 6.

In this embodiment, the first substrate 5 and the second substrate 6 are both bonded to the third reverse face 72 of the third substrate 7. To be more detailed, the third reverse face 72 includes a portion on the upstream side in the y-direction, and a portion on the downstream side in the y-direction, the portion on the upstream side in the y-direction being bonded to the second substrate obverse face 61, and the portion on the downstream side in the y-direction being bonded to the first substrate obverse face 51.

In this embodiment also, the first substrate 5 and the second substrate 6 are bonded to the third substrate 7, which has high flexibility. Therefore, the same advantages as those provided by the first embodiment can be attained. Unlike the illustrated example, the first substrate 5 and the second substrate 6 may both be bonded to the third obverse face 71 of the third substrate 7. Further, the portion of the third reverse face 72 on the upstream side in the y-direction may be bonded to the second substrate obverse face 61, and the portion of the third obverse face 71 on the downstream side in the y-direction may be bonded to the first substrate reverse face 52.

Figure 23:
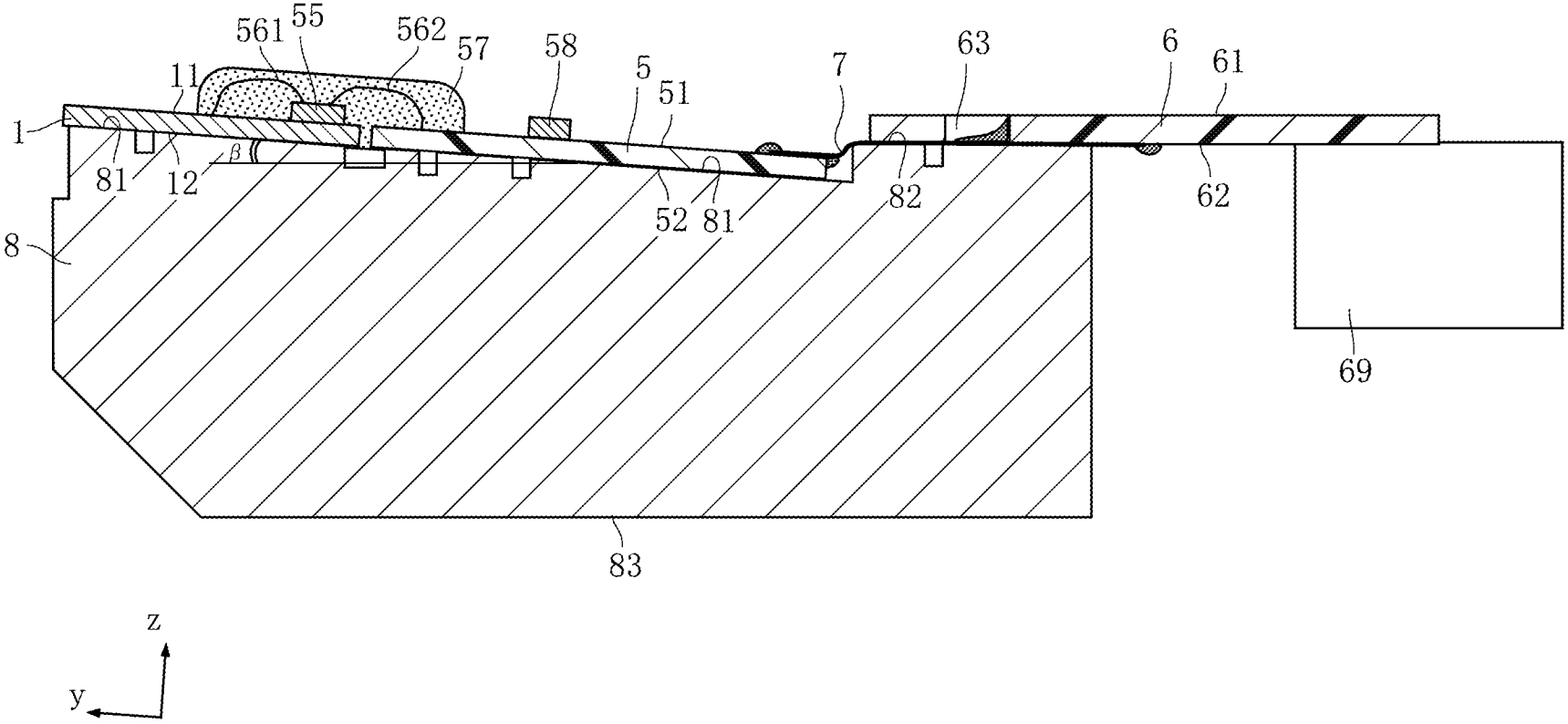
FIG. 23 is a cross-sectional view showing a thermal print head according to a seventh embodiment.

FIG. 23 is a cross-sectional view of a thermal print head according to a seventh embodiment, showing the portion corresponding to FIG. 4.

In this embodiment, the driver IC 55 is mounted on the heat-generating substrate obverse face 11. Although the driver IC 55 is not mounted on the first substrate 5, the wire 562 is bonded to the first wiring, and therefore the Au-plated layer of high purity is formed by electrolytic plating on the first wiring of the first substrate 5, as in the first embodiment.

In this embodiment also, the first substrate 5 and the second substrate 6 are bonded to the third substrate 7, which has high flexibility. Therefore, the same advantages as those provided by the first embodiment can be attained.

Figure 24:
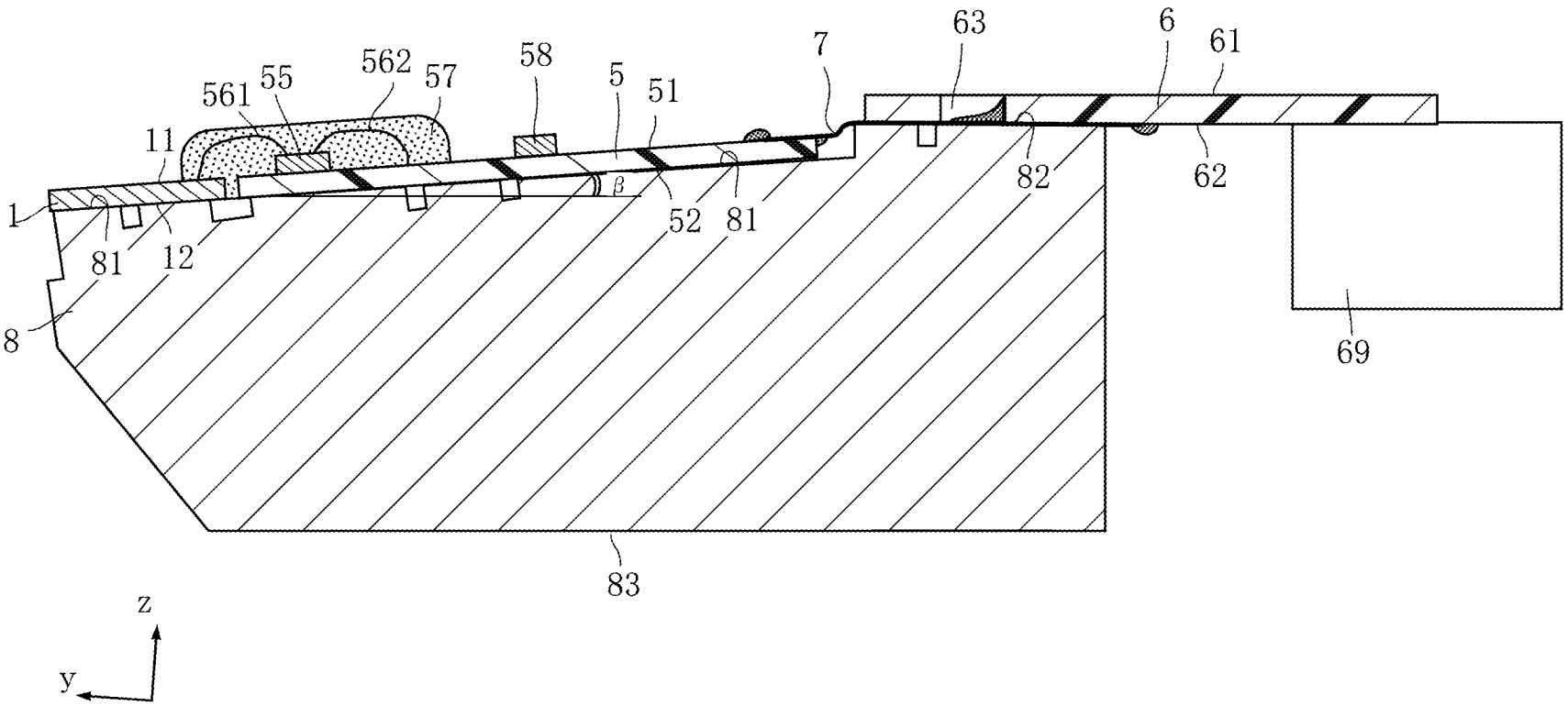
FIG. 24 is a cross-sectional view showing a thermal print head according to an eighth embodiment.

FIG. 24 is a cross-sectional view of a thermal print head according to an eighth embodiment, showing the portion corresponding to FIG. 4.

In this embodiment, the first supporting surface 81 of the heat-dissipating member 8 is inclined in a direction different from the inclination direction of the first supporting surface 81 according to the first embodiment. The inclination direction of the first supporting surface 81 with respect to the bottom face is the same as that of the second slanting face 142 with respect to the heat-generating substrate reverse face 12. Therefore, the angle defined by the second slanting face 142 with respect to the bottom face 83 (reference plane) of the heat-dissipating member 8 becomes 34° (=30°+4°). Thus, the angle defined by the second slanting face 142 with respect to the bottom face 83 (reference plane) of the heat-dissipating member 8 can be set to a desired angle, by adjusting the angle $\beta$ of the first supporting surface 81 with respect to the bottom face 83.

In this embodiment also, the first substrate 5 and the second substrate 6 are bonded to the third substrate 7, which has high flexibility. Therefore, the same advantages as those provided by the first embodiment can be attained. The angle $\beta$ may be 0°, in other words, the first supporting surface 81 may be parallel to the bottom face 83.

Figure 25:
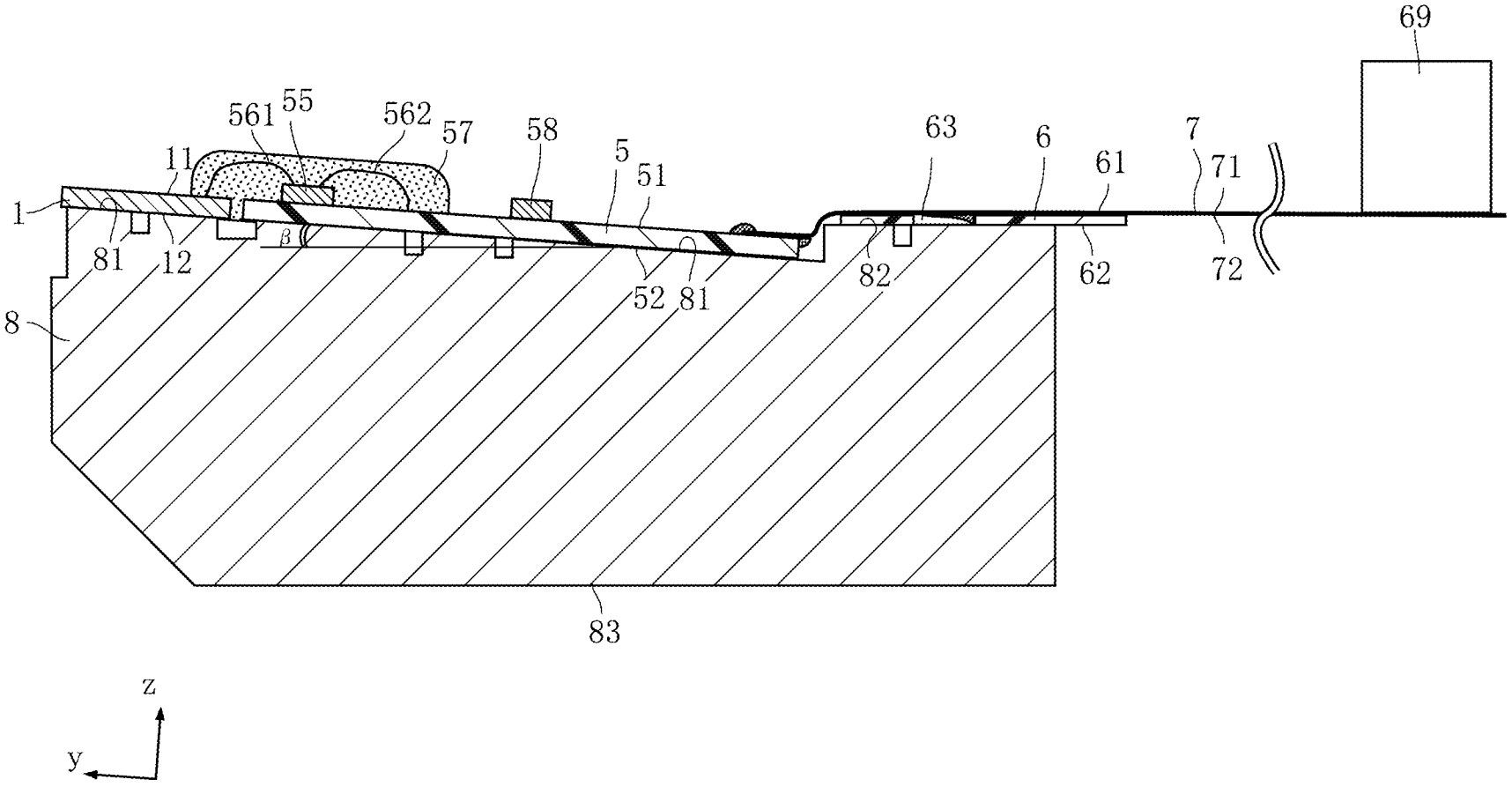
FIG. 25 is a cross-sectional view showing a thermal print head according to a ninth embodiment.

FIG. 25 is a cross-sectional view of a thermal print head according to a ninth embodiment, showing the portion corresponding to FIG. 4.

In this embodiment, the third substrate 7 further extends to the upstream side in the y-direction, and the connector 69 is mounted on the end portion of the third obverse face 71 on the upstream side in the y-direction. The connector 69 may be mounted on the end portion of the third reverse face 72 on the upstream side in the y-direction. The other circuit elements mounted on the second substrate 6 in the first embodiment are mounted on the region of the third obverse face 71 of the third substrate 7 overlapping with the second substrate 6, when viewed in the z-direction.

In this embodiment also, the first substrate 5 and the second substrate 6 are bonded to the third substrate 7, which has high flexibility. Therefore, the same advantages as those provided by the first embodiment can be attained.

The thermal print head according to the present disclosure is not limited to the foregoing embodiments. The specific configurations of the thermal print head according to the present disclosure may be designed in various different manners.

Clause 1.

A thermal print head including:

a heat-generating substrate having a heat-generating substrate obverse face and a heat-generating substrate reverse face that are spaced apart from each other in a thickness direction;

a resistor layer supported by the heat-generating substrate;

a conductive layer supported by the heat-generating substrate and electrically connected to the resistor layer;

a first substrate located upstream of the heat-generating substrate in a sub-scanning direction;

a second substrate located upstream of the first substrate in the sub-scanning direction; and a third substrate bonded to the first substrate and the second substrate, the third substrate being higher in flexibility than the first substrate.

Clause 2.

The thermal print head according to clause 1, in which the second substrate is inclined with respect to the first substrate.

Clause 3.

The thermal print head according to clause 1 or 2, further including at least one driver IC, in which the resistor layer includes a plurality of heating elements aligned in a main scanning direction, and the at least one driver IC is mounted on the first substrate, and controls power supply to the plurality of heating elements.

Clause 4.

The thermal print head according to any one of clauses 1 to 3, further including a thermistor mounted on the first substrate.

Clause 5.

The thermal print head according to any one of clauses 1 to 4, further including a heat-dissipating member, in which the heat-dissipating member includes a first supporting surface on which the first substrate is located, and a second supporting surface on which the second substrate is located, the second supporting surface being inclined with respect to the first supporting surface.

Clause 6.

The thermal print head according to any one of clauses 1 to 5, in which the heat-generating substrate is made of a monocrystalline semiconductor.

Clause 7.

The thermal print head according to clause 6, in which the heat-generating substrate is made of Si.

Clause 8.

The thermal print head according to clause 6 or 7, in which the heat-generating substrate obverse face is a (100) plane.

Clause 9.

The thermal print head according to any one of clauses 6 to 8, further including an insulation layer interposed between the heat-generating substrate and the resistor layer.

Clause 10.

The thermal print head according to any one of clauses 1 to 5, in which the heat-generating substrate is made of a ceramic.

Clause 11.

The thermal print head according to any one of clauses 1 to 10, in which the heat-generating substrate includes a heat-generating substrate end face orthogonal to the sub-scanning direction and oriented to a downstream side in the sub-scanning direction, and a heat-generating substrate slanting face connected to the heat-generating substrate obverse face and the heat-generating substrate end face, and the resistor layer covers at least a part of the heat-generating substrate slanting face.

Clause 12.

The thermal print head according to clause 11, in which the heat-generating substrate slanting face includes a first slanting face connected to the heat-generating substrate end face, and a second slanting face connected to the heat-generating substrate obverse face, and the second slanting face is inclined with respect to the first slanting face, such that a boundary between them has a convex shape.

Clause 13.

The thermal print head according to clause 12, in which an angle between the first slanting face and the heat-generating substrate obverse face is 54.7°, and an angle between the second slanting face and the heat-generating substrate obverse face is 30°.

Clause 14.

The thermal print head according to any one of clauses 1 to 10, in which the heat-generating substrate includes a protrusion protruding from the heat-generating substrate obverse face and extending in the main scanning direction, and the resistor layer covers at least a part of the protrusion.

Clause 15.

The thermal print head according to any one of clauses 1 to 14, in which the third substrate includes a third obverse face, and a third reverse face located on an opposite side of third obverse face, the first substrate is bonded to the third reverse face, and the second substrate is bonded to the third obverse face.

Clause 16.

The thermal print head according to clause 15, further including a bonding reinforcement member, in which the second substrate includes a through-hole overlapping with the third obverse face, and the bonding reinforcement member is in contact with the third obverse face and an inner wall of the through-hole.

Clause 17.

The thermal print head according to any one of clauses 1 to 16, in which a wiring containing Au is formed on the first substrate.

REFERENCE SIGNS

A1 to A9 thermal print head
1 heat-generating substrate
11 heat-generating substrate obverse face
12 heat-generating substrate reverse face
13 heat-generating substrate end face
14 heat-generating substrate slanting face
141 first slanting face
142 second slanting face
15 heat-generating substrate top face
16 heat-generating substrate slanting face
161 third slanting face
162 fourth slanting face

18 insulation layer
19 glaze layer
2 protective layer
21 opening for pad
3 conductive layer
31 individual electrode
311 individual pad
32 common electrode
323 common region
324 belt-like portion
33 relay electrode
4 resistor layer
41 heating element
5 first substrate
51 first substrate obverse face
52 first substrate reverse face
55 driver IC
561, 562 wire
57 protective resin
58 thermistor
59 capacitor
6 second substrate
61 second substrate obverse face
62 second substrate reverse face
63 through-hole
69 connector
7 third substrate
71 third obverse face
72 third reverse face
75 bending range
76 to 79 bonding reinforcement member
8 heat-dissipating member
81 first supporting surface
82 second supporting surface
83 bottom face
91 platen roller
95 support tape
1A substrate material
11A obverse face
12A reverse face
15A top face
17A protrusion
140A recess
141A slanting face
142A slanting face
145A bottom face
161A slanting face
162A slanting face

The invention claimed is:

1. A thermal print head comprising:

a heat-generating substrate including a heat-generating substrate obverse face and a heat-generating substrate reverse face that are spaced apart from each other in a thickness direction;

a resistor layer supported by the heat-generating substrate;

a conductive layer supported by the heat-generating substrate and electrically connected to the resistor layer;

a first substrate located upstream of the heat-generating substrate in a sub-scanning direction;

a second substrate located upstream of the first substrate in the sub-scanning direction; and a third substrate bonded to the first substrate and the second substrate, the third substrate being higher in flexibility than the first substrate, wherein the heat-generating substrate includes a heat-generating substrate end face orthogonal to the sub-scanning direction and oriented to a downstream side in the sub-scanning direction, and a heat-generating substrate slanting face connected to the heat-generating substrate obverse face and the heat-generating substrate end face, and the resistor layer covers at least a part of the heat-generating substrate slanting face.

2. The thermal print head according to claim 1, wherein the second substrate is inclined with respect to the first substrate.

3. The thermal print head according to claim 1, further comprising at least one driver IC, wherein the resistor layer includes a plurality of heating elements aligned in a main scanning direction, and the at least one driver IC is mounted on the first substrate and configured to control power supply to the plurality of heating elements.

4. The thermal print head according to claim 1, further comprising a thermistor mounted on the first substrate.

5. The thermal print head according to claim 1, further comprising a heat-dissipating member, wherein the heat-dissipating member includes a first supporting surface on which the first substrate is located, and a second supporting surface on which the second substrate is located, the second supporting surface being inclined with respect to the first supporting surface.

6. The thermal print head according to claim 1, wherein the heat-generating substrate is made of a monocrystalline semiconductor.

7. The thermal print head according to claim 6, wherein the heat-generating substrate is made of Si.

8. The thermal print head according to claim 6, wherein the heat-generating substrate obverse face is a (100) plane.

9. The thermal print head according to claim 6, further comprising an insulation layer interposed between the heat-generating substrate and the resistor layer.

10. The thermal print head according to claim 1, wherein the heat-generating substrate is made of a ceramic.

11. The thermal print head according to claim 1, wherein the heat-generating substrate slanting face includes a first slanting face connected to the heat-generating substrate end face, and a second slanting face connected to the heat-generating substrate obverse face, and the second slanting face is inclined with respect to the first slanting face, such that a boundary has a convex shape.

12. The thermal print head according to claim 11, wherein an angle between the first slanting face and the heat-generating substrate obverse face is 54.7°, and an angle between the second slanting face and the heat-generating substrate obverse face is 30°.

13. The thermal print head according to claim 1, wherein the heat-generating substrate includes a protrusion protruding from the heat-generating substrate obverse face and extending in the main scanning direction, and the resistor layer covers at least a part of the protrusion.

14. The thermal print head according to claim 1, wherein the third substrate includes a third obverse face, and a third reverse face located on an opposite side of third obverse face, the first substrate is bonded to the third reverse face, and the second substrate is bonded to the third obverse face.

15. The thermal print head according to claim 14, further comprising a bonding reinforcement member, wherein the second substrate includes a through-hole overlapping with the third obverse face, and the bonding reinforcement member is in contact with the third obverse face and an inner wall of the through-hole.

16. The thermal print head according to claim 1, wherein a wiring containing Au is formed on the first substrate.

* * * * *